US011428516B2

(12) United States Patent
Spanner et al.

(10) Patent No.: US 11,428,516 B2
(45) Date of Patent: Aug. 30, 2022

(54) METALLIC SOLID PROJECTILE, TOOL ARRANGEMENT AND METHOD FOR PRODUCING METALLIC SOLID PROJECTILES

(71) Applicant: RUAG Ammotec GmbH, Fürth (DE)

(72) Inventors: Florian Spanner, Nuremberg (DE); Heinz Riess, Fürth (DE); Marcus Stier, Neunburg vorm Wald (DE)

(73) Assignee: RUAG AMMOTEC GMBH, Fürth (DE)

( * ) Notice: Subject to any disclaimer, the term of this patent is extended or adjusted under 35 U.S.C. 154(b) by 299 days.

(21) Appl. No.: 16/322,987

(22) PCT Filed: Aug. 2, 2017

(86) PCT No.: PCT/EP2017/069488
§ 371 (c)(1),
(2) Date: Feb. 4, 2019

(87) PCT Pub. No.: WO2018/024754
PCT Pub. Date: Feb. 8, 2018

(65) Prior Publication Data

US 2019/0186881 A1 Jun. 20, 2019

(30) Foreign Application Priority Data

Aug. 5, 2016 (DE) ..... 10 2016 009 571.7

(51) Int. Cl.
*F42B 12/34* (2006.01)
*F42B 8/12* (2006.01)
(Continued)

(52) U.S. Cl.
CPC ..... *F42B 12/34* (2013.01); *F42B 8/12* (2013.01); *F42B 12/74* (2013.01); *F42B 30/02* (2013.01)

(58) Field of Classification Search
CPC ..... F42B 12/34; F42B 8/12; B21K 1/025
(Continued)

(56) References Cited

U.S. PATENT DOCUMENTS 1,892,158 A 12/1932 Matthews
3,069,748 A 12/1962 Nosler
(Continued)

FOREIGN PATENT DOCUMENTS

DE 26 50 136 A1 5/1978
DE 83 28 476 U1 8/1987
(Continued)

OTHER PUBLICATIONS

International Search Report for PCT/EP2017/069488, dated Oct. 20, 2017, and English Translation submitted herewith (8 pgs.).
(Continued)

*Primary Examiner* — Reginald S Tillman, Jr.
(74) *Attorney, Agent, or Firm* — Fitch, Even, Tabin & Flannery, LLP

(57) ABSTRACT

Metallic solid projectile for practice cartridges, in particular for use on preferably police shooting ranges, wherein the solid projectile comprises a front-side ogival portion and a cylinder portion for holding the solid projectile in a cartridge case and defines a projectile length in the axial direction, wherein the ogival portion has an ogival wall and a rotationally symmetrical ogival cavity circumferentially bounded by the ogival wall, wherein it is provided that a fully cylindrical stem portion of the solid projectile extends in the axial direction over less than 45% of the projectile length.

11 Claims, 11 Drawing Sheets

(51) Int. Cl.
*F42B 12/74* (2006.01)
*F42B 30/02* (2006.01)

(58) Field of Classification Search
USPC ..... 102/507–509; 86/55
See application file for complete search history.

(56) References Cited

U.S. PATENT DOCUMENTS 4,175,492 A * 11/1979 Knappworst ..... F42B 12/34 102/503
5,131,123 A * 7/1992 Brooks ..... B21K 1/025 86/54
5,259,320 A 11/1993 Brooks
5,621,186 A * 4/1997 Carter ..... F42B 12/34 102/507
5,943,749 A 8/1999 Swank
6,776,101 B1 * 8/2004 Pickard ..... F42B 12/34 102/507
2014/0318406 A1 * 10/2014 Rall ..... F42B 33/001 102/510
2015/0233687 A1 8/2015 Krause et al.
2019/0170489 A1 * 6/2019 Smith ..... F42B 12/34

FOREIGN PATENT DOCUMENTS

DE 10 2011 005389 B3 3/2012
DE 10 2012 003682 A1 2/2014
DE 10 2013 014 693 A1 3/2014
EP 2 133 655 A2 12/2009
EP 2 498 045 A1 9/2012
WO 2005/075932 A1 8/2005

OTHER PUBLICATIONS

International Preliminary Report on Patentability of Appln. No. PCT/EP2017/069488 dated Feb. 14, 2019 with English translation.

* cited by examiner

METALLIC SOLID PROJECTILE, TOOL ARRANGEMENT AND METHOD FOR PRODUCING METALLIC SOLID PROJECTILES

CROSS-REFERENCE TO RELATED APPLICATIONS

This application is a U.S. national phase application filed under 35 U.S.C. § 371 of International Application No. PCT/EP2017/069488, filed Aug. 2, 2017, designating the United States, which claims priority from German Patent Application No. 10 2016 009 571.7, filed Aug. 5, 2016, which are hereby incorporated herein by reference in their entirety.

The invention relates to a metallic solid projectile for practice cartridges, in particular for use on police firing ranges. The invention also concerns a tool arrangement for the production of metallic solid projectiles for training cartridges. The invention also includes a method for producing metallic solid projectiles for practice cartridges. For use on police shooting ranges, projectiles for training cartridges must meet the requirements of the "Technical Directive (TR) Cartridge 9 mm×19, Reduced Pollutant" (in particular: as of September 2009), with the proviso that for training cartridges some of the requirements of the aforementioned technical directive for training cartridges, inter alia with regard to the end-ballistic effect, need not be met.

A standard solid projectile for practice cartridges is known from EP 2 498 045 A1. The conventional solid projectile consists of a curved ogive at the front and a cylindrical area adjacent to it. In the area of the curved ogive, the known solid projectile is equipped with an ogival wall which circumferentially bounds an ogival cavity and is formed on the inside with predetermined breaking points in the form of notches and edges. These predetermined breaking points serve as predetermined zones for initiating or promoting material failure. They facilitate the folding of the projectile solid material with the formation of cracks in the outer skin of the ogive when the projectile strikes a target at the front. When the projectile hits its target according to EP 2 498 045 A1, it should deform ("mushroom up"). When the projectile is deformed, its kinetic energy is converted into deformation energy. The conversion of kinetic energy into deformation energy should take place as quickly as possible in practice cartridge projectiles in order to prevent the projectile from remaining with sufficient kinetic energy to penetrate in particular protective vests, for example police protective vests. In the case of the well-known solid projectile for practice cartridges, it has been found to be disadvantageous that the crack effect of the predetermined breaking points can cause the projectile to splinter on impact with the target or a hard surface, such as the wall of a shooting range. The splintering of a practice projectile can result in dangerous cross impact splinters for practicing shooters.

It is an object of the invention to provide a metallic solid projectile for practice cartridges, which overcomes the disadvantages of the state of the art, in particular in compliance with the "Technical Guideline (TR) Cartridge 9 mm×19, reduced pollutant", and in which the splintering of the solid projectile on impact with a hard surface is avoided.

This problem is solved by the subject matter of the independent claims.

Accordingly, a metallic solid projectile is provided for practice cartridges, in particular for use on preferably police shooting ranges, wherein the solid projectile comprises a front-side ogival portion and a cylinder portion for holding the solid projectile in a cartridge case and defines a projectile length in the axial direction. Solid projectiles differ from partial jacket projectiles and solid jacket projectiles in that a solid projectile is formed in one piece, in particular from a homogeneous material. The solid projectile is intended in particular for practice cartridges for use in handguns, i.e. revolvers, submachine guns and/or pistols. A metallic solid projectile may also be provided for training cartridges for rifles. Preferably the solid projectile is intended for practice cartridges up to a caliber of 20 mm, in particular up to a caliber of 12 mm. Cartridges usually consist of a projectile, a cartridge case, propellant powder and a primer. The projectile is the object fired from the weapon. The weight of a projectile can be between 3 g and 20 g, in particular between 5 g and 15 g, preferably between 5.5 g and 9 g, in particular preferably between 6.0 g and 6.3 g, for example 6.1 g, for a cartridge caliber of 9 mm×19 (Luger caliber or Para caliber), when using which the penetration of a protective vest is to be ruled out. Due to their weight and shape, the projectiles of standard Luger caliber cartridges reach muzzle velocities of 340 mm/sec. or more at 9 mm. The material of the solid projectile is preferably lead-free and/or lead alloy-free. The metal of the solid projectile is preferably copper. In particular, at least 95%, at least 99% or at least 99.9% of the metal of the solid projectile consists of copper. The particularly uncoated projectile consists particularly preferably of pure copper (Cu-ETP), preferably with a specific weight of 8.93 g/cm$^3$, in particular of CU-ETP1 according to DIN EN1977 with at least 99.9% copper content and less than 100 ppm oxygen. According to less preferred configurations, the metal material of the solid projectile may be brass (i.e. a mixture of copper and zinc such as tombac). The specific weight of copper is 8.9 g/ccm. The specific weight of zinc is 7.2 g/ccm. The specific weight of brass is at least 8.3 g/ccm, while the specific weight of tombak is about 8.6 g/ccm.

Preferably the cylinder section of the solid projectile is directly adjacent to the ogival section, in particular the arcuate ogival section. The ogival section arranged at the front in the flight direction of the solid projectile can be described as the front side. The rear cylinder section of the solid projectile in the flight direction of the projectile can be designated as the foot side or the rear side. The ogival section is arranged axially in front of the cylinder section of the solid projectile. The cylinder section preferably has a circular outer contour in cross-section. The shape of the cylinder section preferably corresponds to a vertical or straight circular cylinder. The rear end of the cylinder section may have a chamfered section to facilitate the insertion of the solid projectile into a neck of a cartridge case and/or to form a particularly aerodynamic rear end (generally referred to as the "boat tail"). Preferably, the metallic solid projectile consists of the frontal ogival section and the rear cylindrical section.

In a strictly geometric sense, an ogive is a form in three-dimensional space that is created by the rotational body of the intersection of two circular arcs. Based on the geometric term, similarly shaped profiles of ballistic projectile tips, are called in longitudinal section, which should have as little air resistance as possible when moving. Ogive can be understood as a streamlined body of revolution, which can be pointed or rounded (flattened) at the front.

The ogival section has an ogival wall and a rotationally symmetrical ogival cavity circumferentially bounded by the ogival wall. The ogival cavity of the hollow projectile according to the invention allows the projectile to deform in the form of a compression on impact with a target or other resistance. When the projectile is compressed, its kinetic energy is quickly converted into deformation energy. When the projectile is compressed, the tip of the projectile deforms only in the axial direction, preferably relative to the cylinder section. In particular, when the projectile hits a flat resistance perpendicularly, there is preferably no deformation of the projectile tip in the radial direction across the diameter of the undeformed cylinder section. The ogival cavity is preferably empty, i.e. only filled with ambient air. An inner contour encompassing the ogival cavity, defined by the ogival wall, is preferably formed step-free and/or uninterrupted in the circumferential direction and/or has only rounded edges. An outer side of the ogival defined by the ogival wall is preferably formed without steps in the circumferential direction and/or has a constant wall thickness circumferentially, in particular completely.

Preferably the projectile at or near its tip is harder than at the rear. For example, the tip may have a hardness between 110 HV0.5 to 200 HV0.5, in particular 120 HV0.5 to 160 HV0.5, preferably 130 HV0.5 to 150 HV0.5. The cylinder section may have a low hardness, for example a hardness between 50 HV0.5 to 160 HV0.5, in particular 75 HV0.5 to 155 HV0.5, preferably 85 HV0.5 to 150 HV0.5.

According to a first aspect of the invention, a fully cylindrical, i.e. massive, stem section of the solid projectile extends in axial direction over less than 45%, less than 40%, less than 30%, less than 20%, less than 10%, less than 5%, or over 0%, preferably between 40% and 0%, in particular between 20% and 10% or 0%, of the projectile length. Compared to the solid projectile known from EP 2 498 045 A1, in which an ogive cavity in the area of the frontal curved ogive is located only in the tip area of the projectile, so that behind the ogive cavity a long, massive stem section is formed, it has surprisingly proved to be advantageous to form a solid projectile for training cartridges with a significantly shortened stem section or without a stem section at all: Surprisingly, this has not reduced the stability of the projectile to such an extent that there is a risk of fragmentation. Nor is the self-loading function of conventional semi-automatic handguns impaired. The reduction of the axial height of a fully cylindrical stem section in accordance with the invention significantly increases its upsetting tendency, so that on impact of the projectile its kinetic energy can be converted extremely quickly and effectively into deformation energy. The safety of the practicing shooter and other persons on the shooting range is thus considerably improved.

According to a second aspect of the invention which can be combined with the above mentioned, the invention concerns a metallic solid projectile for practice cartridges in particular for use on preferably police shooting ranges, the solid projectile comprising a frontal ogive portion and a cylinder portion for holding the solid projectile in a cartridge case. The ogival section and/or the cylinder section can be configured as described above. In contrast to hunting projectiles, for example, in which the mushrooming of the projectile is to be accompanied by a spreading of the projectile in the shape of a petal, it may be desirable for practice cartridges to be accompanied by a substantially symmetrical compression or folding radially inwards without a spreading of the petal in the shape of a petal in order to avoid splintering.

A rotationally symmetric compression or folding without spreading of the solid projectile is guaranteed by the rotation symmetry of the ogival cavity, especially free of steps and/or changes of the wall thickness of the ogival wall in circumferential direction. The ogival cavity may preferably be bell-shaped in cross-section.

According to the second aspect of the invention, the ogival cavity has a bottom. The bottom of the ogival cavity is preferably located at the rear or far from the front of the projectile. Starting from the bottom of the ogival cavity, a shaft extends into the cylinder section according to the second aspect of the invention. The shaft extending into the cylinder section may have a microchannel and/or a deformation cavity. The deformation cavity of the chamber may be at least sectionally cylindrical and/or at least sectionally conical with tapered ends. Preferably, the deformation cavity is heart-shaped or ideally conical.

In accordance with the second aspect of the invention, a solid projectile is equipped with an interior space which, in addition to the ogival cavity, has a further deformation cavity extending in the axial direction in the rear, which promotes radial impact deformation of the practice cartridge solid projectile over much of the length of the projectile or even the entire length of the projectile. The shaft extending from the bottom of the ogival cavity into the cylinder section can also be described as a gap or throat. For example, a throat-like shaft can be realized by a parabolic funnel-shaped tapering starting from the ogival cavity, which provides a capillary-like microchannel. A capillary-like microchannel preferably has a microscopic opening width. Along a capillary-like microchannel or capillary section, the shaft is constricted or constricted at least in sections in such a way that the inner wall of the shaft is formed into a linear constriction. A fusion of the metal material of the solid projectile transversely to its axial direction, in particular by removing the metal grain boundaries, preferably does not take place along the capillary section.

According to a preferred configuration of the invention, the ogival wall has an ogival wall thickness and the solid projectile forms an annular deformation sleeve wall in the cylinder section in the axial direction, at least in sections, which has a deformation sleeve wall thickness. The deformation sleeve wall thickness is greater than the ogival wall thickness. Preferably, the ogival wall extends over at least 50%, preferably at least 55% and/or at most 75%, preferably at most 60%, of the projectile length. The axial extension of the deformation sleeve wall preferably extends between the bottom of the ogival cavity and, if present, the rear section of the solid projectile or the lowest end or foot or tail of the solid projectile. The inner side of the deformation sleeve wall circumferentially borders a preferably rotationally symmetrical deformation cavity and/or microchannel. The inner side of the ring-shaped deformation sleeve wall can have a diagonal clear width, preferably a clear diameter width, which changes particularly in axial direction. In a microchannel, the clear width can extend diagonally between the opposite deformation sleeve inner sides via 10 μm and 1 μm, for example between 10 μm and 500 μm or approximately via 100 μm. A microchannel may also have a capillary section with an average clear width of less than 10 μm or 1 μm The rear or foot end of the shaft is preferably dome-shaped or blind hole-shaped at the flat butt end.

In the ogival cavity, the clear width can be up to several millimetres. For example, an ogive cavity can have a clear width of up to 8 mm, preferably up to 7.5 mm, in particular about 7.46 mm, in a solid projectile of the 9 mm Luger caliber in accordance with the invention.

In particular, the mean deformation sleeve thickness (determined in radial direction over the height of the deformation sleeve section in axial direction) can be greater than the mean ogival wall thickness (determined in radial direction over the axial height of the ogival section). Preferably the smallest deformation sleeve wall thickness is greater than the largest ogival wall thickness. Preferably, the largest or mean ogival wall thickness in particular is smaller than half the largest outer radius of the solid projectile, in particular larger than half the solid projectile caliber. Alternatively or additionally, the deformation sleeve wall thickness is less than or equal to the radius of the solid projectile, in particular less than or equal to half the caliber of the solid projectile. In particular, the ogival wall thickness may be less than ¼ of the largest radius of the solid projectile, less than ⅛ or less than 1/10 of half the radius of the solid projectile. In particular, the ogival wall thickness shall be less than 3 mm, less than 2 mm, less than 1.5 mm, less than 1 mm or less than 0.8 mm. In particular, the ogival wall thickness is greater than 0.1 mm, greater than 0.3 mm, greater than 0.5 mm or greater than 1 mm. Preferably, the mean ogival wall thickness is between 1.0 mm and 1.5 mm.

According to a preferred configuration of the invention, the solid projectile is blunt at the front-side. A blunt solid projectile can have a flattened projectile front-end, for example. Preferably, the opening angle of the blunt solid projectile can be greater than 150° at its frontmost point, which can be designated as the apex. The opening angle of the blunt solid projectile at its top is preferably between 150° and 180°, especially at about 180°. One millimetre axially from the tip of a blunt solid projectile, an opening angle tangent (of the outside of the projectile) can be greater than 1200 and, in particular, lie between 120° and 140°, for example at about 130°. At a distance of 2 mm in the axial direction from the blunt tip of a solid projectile, an opening angle tangent (a second point on the outside of the projectile) can be greater than 90°, e.g. between 900 and 110°, especially at about 100°.

In a preferred configuration of the invention, the solid projectile has a front-sided opening that leads into the ogival cavity. A smallest or inner diameter of the opening is larger than the average or smallest ogival wall thickness and/or is larger than the opening width of a microchannel and/or larger than 1 mm, 2 mm or even 3 mm. Preferably the opening width is smaller than 7 mm, smaller than 5 mm or smaller than 4 mm. Solid projectiles with an opening width at the front of approximately 1.3 mm+/−0.15 mm are particularly preferred. Surprisingly, such a dimension has resulted in particularly good aerodynamics and an advantageous mushrooming behaviour, especially for solid copper projectiles.

In a preferred configuration of the invention, the fully cylindrical stem section extends in the axial direction over less than 3 mm, less than 2 mm, or less than 1 mm. Alternatively or additionally, a calotte may be recessed at the rear end of the solid projectile, which may, for example, be dome-shaped, cone-shaped or frustoconical. The calotte is preferably coaxial and/or concentric with the axis of symmetry or rotation A of the solid projectile. If a calotte is present, the solid stem height extends between its projectile frontal apex and the rear end of the shaft, which forms the microchannel and/or deformation cavity. Preferably the calotte is frustoconical or conical with an opening angle between 100° and 140°, preferably about 100°, and/or a calotte depth in the axial direction of at least 0.5 mm or at least 1 mm and at most 2.5 mm, preferably at most 2 mm, in particular about 1.5 mm. In particular, the calotte is rotationally symmetrical. A chamfer, preferably a frustoconical chamfer, with an opening angle between 30° and 90°, in particular about 60°, and a chamfer height of less than 2 mm, preferably less than 1 mm, in particular about 0.5 mm, can be formed on the radial outside at the rear end of the cylinder section. The calotte volume shall be less than 15 $mm^3$, preferably less than 10 $mm^3$, in particular approximately 9.8 $mm^3$.

According to a preferred configuration of the invention, an inner contour surrounding the ogival cavity, which is defined in particular by the ogival wall, is completely rounded in the axial direction, preferably without steps, and/or has only rounded edges. The inner contour of the ogival cavity is completely rounded in the axial direction without any steps and/or without any cracks, so that there is preferably no pronounced notching effect.

According to a preferred configuration, the solid projectile corresponds to the 9 mm Luger caliber. If the outside diameter of the projectile is 9.02 mm and the solid projectile is 9 mm Luger caliber, the volume of the ogival cavity and, where appropriate, of the frontal opening and/or a deformation cavity and/or a microchannel may be between 150 $mm^3$ and 200 $mm^3$, preferably between 185 $mm^3$ and 192 $mm^3$, in particular around 189 $mm^3$. The mass of a 9 mm Luger caliber solid projectile according to the invention can be approximately 6.1 g.

In the case of a preferred configuration of a solid projectile in accordance with the invention, this corresponds to one of calibers .357 Mag. and may have an outside diameter of more than 9.12 mm. In the case of an invented solid projectile with .357 Mag. caliber, the cavity volume of the ogive cavity and, where appropriate, the cavity of the front opening and/or the deformation cavity and/or a microchannel may be between 150 $mm^3$ and 220 $mm^3$, in particular approximately 196 $mm^3$.

In a preferred configuration, the invented solid projectile corresponds to the .40 S&W caliber. An invention solid projectile of .40 S&W caliber may have an outer diameter of 10.17 mm. For a solid projectile of caliber .40 S&W according to the invention, the cavity volume can be between 250 $mm^3$ and 290 $mm^3$, preferably between 260 $mm^3$ and 280 $mm^3$, in particular between 270 $mm^3$ and 273 $mm^3$, for example about 271.5 $mm^3$.

In a preferred implementation of the invention, the solid projectile corresponds to the caliber .44 Rem. Mag. A solid projectile of caliber .44 Rem. according to the invention can have an outer diameter of 10.97 mm. In the case of a solid projectile of caliber .44 Rem. Mag. according to the invention, the cavity volume of the ogive cavity and, if applicable, the cavity of the frontal projectile opening and/or the deformation cavity and/or the microchannel can be between 320 $mm^3$ and 360 $mm^3$ and, in particular, between 330 $mm^3$ and 350 $mm^3$, preferably between 339 $mm^3$ and 343 $mm^3$, further preferably between 340 $mm^3$ and 341 $mm^3$, in particular about 340.5 $mm^3$.

In a preferred configuration of the invention, the solid projectile corresponds to the .45 ACP caliber. In the case of a caliber .45 ACP projectile according to the invention, the outside diameter of the projectile may be 11.48 mm. In the case of a solid .45 ACP caliber projectile according to the invention, a cavity volume of the ogive cavity and, where appropriate, an opening volume of a frontal projectile opening and/or a deformation cavity and/or a microchannel may be between 370 $mm^3$ and 410 $mm^3$, preferably between 380 $mm^3$ and 400 $mm^3$, in particular between 388 and 393 $mm^3$, in particular between 389 $mm^3$ and 391 $mm^3$, preferably about 390.5 $mm^3$.

According to the invention, the metallic solid projectile for practice cartridges has an ogival section with an ogival wall and a rotationally symmetrical ogival cavity which is circumferentially limited by the ogival wall, especially in the radial direction and preferably completely circumferentially.

The invention also concerns a tool arrangement, in particular a press arrangement, for producing metallic solid projectiles for practice cartridges, preferably with a rotationally symmetrical ogival cavity, in particular for police practice shooting ranges. The tool arrangement in accordance with the invention is especially configured for the production of a metallic solid projectile as described above. An inventive tool arrangement comprises a preforming press or a preforming station with a hollow-cylindrical, in particular ideal-cylindrical, projectile blank receiving means or preforming die, which is bounded in the axial direction by a bottom side, in particular a rear punch, a preforming punch, having a preforming section, in particular rotationally symmetrical, which tapers in the axial direction to a front surface preferably at least in sections conically, in particular in the form of a truncated cone. In particular, the preform punch also has a guide section which is complementary in radial direction to the shape of the projectile blank receiving means and in particular adjoins the preform section in axial direction.

According to the invention, the preform section is movable relative to the bottom side for forming a projectile blank up to a preform end position in which the preform punch, the bottom side and the projectile blank receiving means define a preform cavity for the preformed projectile blank (first stage). The preform press may include a drive for pressing the preform section into a projectile blank located in the projectile blank receptacle. The bottom side of the preforming station is preferably realized by a rear punch, which is movable in axial direction relative to the preforming punch and/or the projectile blank receptacle.

According to the invention, in the preform final position, an axial distance between the bottom side of the preform press projectile blank receptacle (the bottom side of the die of the preform station) and the front surface of the preform punch is less than 45%, in particular less than 40%, less than 30%, less than 20%, less than 10% or less than 5%, of a maximum cavity height in axial direction. If the preform portion of the preform die is frustoconical, the largest height of the cavity may extend between the base of the frustoconical of the preform die and a portion of the bottom side of the preform press projectile blank receptacle furthest therefrom, preferably the top face of the rear punch.

In accordance with a preferred configuration of an inventive tool arrangement, the tool arrangement also includes an inner contour forming press. The inner contour forming press or inner contour station has a hollow cylindrical, in particular ideal cylindrical, projectile blank receptacle or inner contour outer die, which is axially limited by an (inner contour) bottom side, in particular a rear punch. The inner contour forming press may comprise the same projectile blank receptacle and/or the same bottom side, preferably the same rear punch, as the preforming press. The inner contour forming press may comprise a different projectile blank receptacle and/or a different bottom side, preferably a different rear punch, than the preforming press. The inner contour forming press comprises an inner contour forming punch having an inner contour forming section extending axially to a front surface of the inner contour forming punch. The inner contour forming section is movable relative to the bottom side of the inner contour forming press for forming the projectile blank to an inner contour forming end position in which the inner contour forming punch, bottom side and projectile blank receptacle define an inner contour forming cavity for the inner contour formed projectile blank (second stage). The bottom side of the inner contour forming station is preferably realized by a rear punch, which is movable in axial direction relative to the inner contour forming punch and/or to the projectile blank receptacle.

The inner contour forming punch can have an inner contour forming punch guide section which is formed in the radial direction complementary to the projectile blank receptacle of the inner contour press and which in particular adjoins the inner contour forming section in the axial direction. The inner contour forming press can have a drive for pressing the inner contour forming section into a projectile blank arranged in the projectile blank receptacle. The drive of the inner contour forming press can be the same or a different drive than that of the preforming press.

According to the preferred configuration of the tool arrangement according to the invention, an axial distance between the bottom and the front surface of the inner contour press is greater than the axial distance between the bottom of the preform press and the front surface of the preform punch in the preform end position, especially in the inner contour final position. The use of different preform pressing and inner contour pressing tools allows a projectile blank to be formed into a preform step without cutting, in particular by cold forming at least in sections or completely in the form of a sleeve by punching in or out, and a predefined inner contour to be introduced into the projectile blank in an inner contour forming step. By using different tools, the desired inner contours can be produced with particular precision, in particular by introducing the desired preload.

In accordance with a preferred further configuration of a press arrangement according to the invention, the front surface of the inner contour forming punch can be formed as a blunt cone tip, in particular with rounded front rim edges. A blunt cone tip can have an opening angle between 1400 and 180°, for example between 150° and 170°, in particular about 160°. If an inner contour forming punch is provided with a blunt cone tip and a sleeve section with an essentially cylindrical outer contour (or a rounded front edge), it may be referred to as a round punch. The rounded front edge may have a radius of curvature of at least 0.5 mm, at least 1 mm, at least 1.5 mm or at least 2 mm and/or at most 10 mm, at most 5 mm, at most 3 mm or at most 2.5 mm. Preferably an ogival radius of curvature near the tip is between 1 mm and 5 mm, preferably between 2 mm and 4 mm, in particular about 3.1 mm. An ogival radius of curvature close to the cylinder section must be between 10 mm and 50 mm, preferably between 20 mm and 30 mm, in particular approximately 23.5 mm.

According to a preferred further configuration of a tool arrangement according to the invention, the inner contour shaped section can be formed in axial direction section by section, preferably completely, as a sleeve shaped section with essentially cylindrical or frustoconical outer contour. A substantially cylindrical outer contour may have a demolding slope of less than 1°, in particular less than 0,5°. For example, a substantially cylindrical sleeve mold section may have a cylinder radius difference of about 0.03 mm at a cylinder length of about 6 mm. The inner contour forming section may, in particular adjacent to a possibly provided guide section of the inner contour forming punch, for example as described above, have a frustoconical transition section extending radially from the inner contour forming section to the guide section, the transition section preferably having an opening angle between 60 and 120°, in particular 90°.

In a preferred further configuration of the inventive tool arrangement, which can be combined with the previous one or ones, the taper of the preform section of the preform punch is more pointed than the preferably tapered outer contour (or essentially cylindrical outer contour) of the inner contour forming section, in particular of the sleeve forming section of the inner contour forming punch. It is clear that a more pointed contour has a smaller opening angle than a blunter outer contour. According to this preferred further configuration of the inventive tool arrangement, the inner contour forming punch is shorter and blunter in relation to the preform punch. The preform punch is preferably truncated cone shaped, especially with a flat front surface and rounded front surface edge, and longer in axial direction than the length of the inner contour punch. The inner contour forming punch can preferably be essentially fully cylindrical with a blunt front surface and a rounded front edge. The inner contour punch is preferably rotationally symmetrical. The forming punch allows the projectile blank to be pierced largely or completely in the axial direction. The inner contour forming punch allows a part of the material of the solid projectile blank to be compressed to form a shoulder and a sleeve section to be formed section by section with a relatively large internal cavity, which can be formed into an ogival cavity with one or more further tools of the tool arrangement.

In accordance with a preferred configuration of a tool arrangement according to the invention, the tool arrangement further comprises a setting press or setting station comprising a hollow cylindrical, in particular ideal cylindrical, metal blank receptacle or setting die, which is delimited in axial direction by a bottom side, which is preferably realized by a rear punch. The die or the metal blank receptacle and the bottom side (setting-rear punch) of the setting press can in turn be different from or the same as the projectile blank receptacle and/or the bottom side of the preforming press and/or the inner contour forming press (preforming and/or inner contour forming rear punch). When the tool arrangement is carried out with setting presses, it also has a setting punch which is movable relative to the bottom side of the setting press for forming a metal blank up to a setting end position in which the setting punch and the projectile blank receptacle form a setting cavity with a predetermined clear width for defining a constant outer diameter, in particular the caliber diameter, of the metal blank. The bottom side of the setting station is preferably realized by a rear punch, which is movable in axial direction relative to the setting punch and/or the die.

Preferably, the setting punch comprises a centering knob coaxial with the metal blank receptacle and/or the bottom side and projecting axially into the cavity for introducing a central, coaxial centering recess into the metal blank. Alternatively or in addition, the bottom side of the setting press has a calotte shape which is coaxial, in particular relative to the metal blank receptacle and/or the setting punch, and protrudes in axial direction A into the cavity, for introducing a calotte into the blank, which calotte is preferably conical, frustoconical or dome-shaped.

In addition or alternatively, the bottom side of the blank receptacle of the setting press may have a circumferential wedge shape radially on the outside to form a projectile rear bevel respectively a projectile rear bevel for inserting the projectile into the neck of a cartridge case and/or for forming a so-called "boat tail".

In accordance with a preferred configuration that can be combined with the previous ones, an inventive tool arrangement also includes an ogival forming press or ogival forming station. This has a hollow-cylindrical projectile blank receptacle or ogival die, which is delimited in the axial direction by a concave, ogival-shaped bottom side, preferably a pointed punch, in particular with a blunt end, and which has a projectile foot punch or ogival die. A projectile rear punch for holding and/or centering the foot end (or the rear) of the internally contour-formed projectile blank, which is movable relative to the bottom side for forming the solid projectile up to an ogival-shaped end position. The projectile foot punch, the projectile blank receptacle and the base side define a cavity which defines a projectile negative with an ogival portion and preferably directly adjacent thereto cylinder portion.

The invention also concerns a method for producing metallic solid projectiles for practice cartridges, preferably with a rotationally symmetrical ogival cavity, in particular for use on police firing ranges. The method consists in providing a metal blank formed in particular from cut-to-length metal wire, preferably with a cylindrical outer surface. The metal blank can be provided, for example, by separating (assembling) a metal blank from a metal wire of predetermined length, predetermined mass and/or predetermined nominal diameter, in particular a predetermined caliber diameter. To provide the metal blank, it can be cut to length from a metal wire by cutting, for example by sawing or milling, or without cutting, for example by punching or cutting.

Alternatively or additionally, a setting tool such as a setting press or setting station can be used to provide the metal blank. When a metal blank is provided using a setting tool, for example, a metal blank with a predetermined mass, for example 1/10 g, 1/100 g or 1/1000 g of precisely dimensioned mass, can be provided, which is brought to a predetermined nominal diameter in a setting step following this finishing step using a setting tool, preferably a setting press, in particular as described above. The metal blank provided is provided in particular in a fully cylindrical form. If the metal blank is provided using a setting tool, an e.g. truncated conical centering recess can be made in the front of the metal blank as part of the setting step. When carrying out a setting step, the metal blank can be formed at the foot end, which in the course of the manufacturing method is transformed into a foot-side projectile part to be inserted into the neck of a practice cartridge case. When providing the metal blank, a calotte and/or an outer chamfer or boat-tail shape can be formed on the metal blank at the rear, for example, particularly in the setting step.

In accordance with the invention, the metal blank is formed in a preforming step into a projectile blank (first stage) with a sleeve-shaped section which, at the end of the preforming step, extends over more than half the size of the axial height of the blank, the sleeve-shaped section in particular being formed with a preferably continuously tapering inner contour. The inner contour of the sleeve-shaped section of the first-stage projectile blank may preferably be conical and/or rotationally symmetrical. It is clear that the taper tapers towards the foot end of the projectile blank. Preferably, the thickness of the case wall in the axial direction of the first-stage projectile blank increases steadily. In the preforming step, the metal blank is preferably formed into a projectile blank with an essentially cylindrical outer surface of constant diameter, forming a sleeve-shaped section on the inside with a preferably conically tapering inner contour.

In the preforming step, a fully cylindrical stem portion may remain at the rear of the projectile blank extending in the axial direction over less than half, less than 40%, less than 30%, less than 20%, less than 10% or less than 5% of the maximum axial projectile blank height. For example, when the projectile blank is formed as described above, the largest axial projectile blank height extends between the upper ring end and the lower ring end of the projectile blank. Preferably, a fully cylindrical stem section of the projectile blank remains after the preform step. Alternatively, during the preforming step, the first-stage projectile blank may have been completely sleeve-shaped so that the projectile blank (first stage) was completely penetrated in the axial direction, in particular by forming an axial passage. A completely penetrated projectile blank is (not only in sections but) completely sleeve-shaped. If a calotte or the like is or has been formed at the foot or tail, it is clear that this calotte has a different inner contour than the preferably continuously tapering inner contour of the sleeve-shaped section formed in the preforming step. In the fully penetrated alternative design, the first stage projectile blank is formed without a remaining fully cylindrical stem section, or with a remaining fully cylindrical stem section of height zero. Preferably, the nominal diameter of the outside of the metal blank in the first stage projectile blank produced by the preforming step is retained unchanged during the preforming step.

In the preferred configuration of an inventive method, the (preformed) projectile blank (first stage) is formed into an (internally shaped) projectile blank (second stage) in an inner contour forming step after the preform step. This is done in such a way that an end-side or front sleeve portion of the projectile blank is formed with a radially outer sleeve wall of substantially constant wall thickness and/or cylindrical inner contour, and that a rear-side or foot-side sleeve portion of the projectile blank is formed with a shoulder projecting radially inwards from the sleeve wall, and that a shaft starting from the shoulder, in particular at its radially inner edge, is formed which extends into the rear sleeve portion of the projectile blank. The shaft in particular forms a microchannel and/or a deformation cavity, wherein the deformation cavity is formed at least in sections cylindrically and/or at least in sections conically with taper at the front side.

The inner contour forming step can preferably be carried out with a particularly tapered and/or rotationally symmetrical inner contour forming punch, such as a round punch, preferably in a projectile blank receptacle or die. The diameter of the cylindrical outer surface of the projectile blank is preferably retained during the inner contour forming step.

At the end of the inner contour forming step, a distance in the axial direction between the shoulder of the second stage projectile blank and a lowermost end of the inner contour formed projectile blank, which may also be referred to as the tail or foot, shall preferably be greater than the axial height of the fully cylindrical stem section of the projectile blank which may be present at the end of the preforming step. The opposite shoulder surfaces are preferably in contact with each other at the front end of a microchannel. The second stage projectile blank can be formed during the inner contour forming step by forming a capillary-like microchannel with a clear width of less than 10 μm or 1 μm. Between the front side sleeve section and the deformation cavity of the projectile blank at the rear, preferably an hourglass-shaped constriction is formed during the inside contour forming step. During the inner contour forming step, the shaft extending rearwardly from the shoulder can be shaped in such a way that a cavity is formed which is at least partially dissolved in the course of the inner contour forming step, in particular with the formation of a microchannel, in that the inner surface of the shaft is brought close to one another, preferably up to a sectional or flat contact.

According to a preferred further configuration of the invention, the projectile blank (second stage) is formed in the inner contour forming step in such a way that the deformation cavity forms a waist-shaped constriction at the front side. When the waist-shaped constriction is formed, a microchannel is formed in particular between the deformation cavity and the shoulder, in which the inner wall surface of the sleeve section is brought together, especially in contact.

Alternatively or additionally, according to a preferred further configuration of the invention, a distance in the axial direction between the shoulder and the foot of the projectile blank (second stage) may be greater than the axial height of the fully cylindrical stem section of the projectile blank (first stage) which may be present at the end of the preforming stage.

According to a preferred configuration of the invention, the method includes an ogival forming step. In an ogival forming step, which can take place after the preforming step and in particular after the inner contour forming step, the projectile blank, in particular the second stage projectile blank, is formed in such a way that the frontal sleeve wall forms an outer surface which is at least in sections ogival in shape. In particular, a frontal opening can be maintained, which preferably opens into an ogival cavity defined circumferentially by the sleeve wall. Preferably, the ogival cavity can be defined on the front side by the shoulder. The ogival forming step can, for example, be effected by pressing the first or second stage projectile blank into an ogival forming tool with an ogival inner contour with the aid of a rear punch which holds the projectile blank at the rear, so that the end sleeve wall, which is defined by the preforming step and, if appropriate, the inner contour forming step, is compressed radially inwards. In the ogival forming step, an ogival cavity is preferably formed which is surrounded by the sleeve wall of the solid projectile. Preferably in the ogival forming step, the projectile blank (first or second stage) is formed into a solid projectile, in particular as described above. The ogival cavity formed in the ogival forming step is preferably formed in the axial direction completely free of edges and/or with rounded edges and/or rounded inner contour. For example, the ogival cavity can be essentially bell-shaped in the ogival forming step.

In accordance with a preferred configuration of the method in accordance with the invention, which can be combined with the execution or further configurations of the method as described above, the preforming step, the inner contour forming step and/or the ogival forming step, as well as, if applicable, the cutting to length step and/or the setting step, if applicable, to be carried out are carried out without cutting, in particular by cold forming, preferably by pressing. A non-cutting inner contour forming step can, for example, be carried out using a preferably tapered, in particular rotationally symmetrical inner contour forming punch, such as a round punch, in a projectile blank receptacle or die.

In accordance with a preferred configuration, the inventive method of making a metallic solid projectile for practice cartridges also includes one or more intermediate and/or posttreatment steps, such as coating steps. In one or more coating steps, a coating is applied to the outer and/or inner surface at least in sections, in particular completely. A coating shall preferably be applied with a coating thickness of less than 500 μm, less than 100 μm, less than 10 μm or less than 3 μm or 1 μm thickness. A coating step may, for example, include a galvanic coating of the solid projectile.

The method according to the invention for producing a metallic solid projectile for practice cartridges can be used in particular to produce a metallic solid projectile according to the invention according to the first and/or second aspect of the invention. The inventive method of making a metallic solid projectile for practice cartridges may preferably be carried out using an inventive tool arrangement for making metallic solid projectiles for practice cartridges. It is clear that a metallic solid projectile according to the invention (in particular according to the first and/or second aspect of the invention) may be manufactured according to one or more steps of the manufacturing method according to the invention. The invention also relates to a projectile manufactured by a method according to the invention for the manufacture of a metallic solid projectile for practice cartridges as described above. A metallic solid projectile according to the invention may preferably be manufactured with a tool arrangement according to the invention.

Preferably, the arrangement of tools according to the invention is configured to create a solid projectile according to the first and/or second aspect of the invention. In particular, the invention tool arrangement may be configured to perform a manufacturing method according to the invention.

The invention also concerns a cartridge with a solid projectile, in particular exactly one, in accordance with the invention. Furthermore, the invention concerns a handgun, preferably a handgun, such as a pistol or a revolver, or a submachine gun, which comprises at least five practice cartridges with a metallic solid projectile in accordance with the invention. Preferably, the handgun or the solid projectile is suitable for cartridges with a caliber of maximum 20 mm, in particular maximum 12 mm. In particular, the cartridge or handgun may be configured for calibers of 9 mm Luger, .357 Mag., .40 S&W, .44 Rem. Mag. or .45 ACP.

Further details, advantages and characteristics of the invention are explained by the following description of preferred executions using the enclosed drawings.

FIG. 1*a* shows a plan view of a solid projectile according to the invention according to a first configuration;

FIG. 1*b* shows a sectional view according to the section line I.-I. of a solid projectile according to invention according to FIG. 1*a;*

Figure 9A:
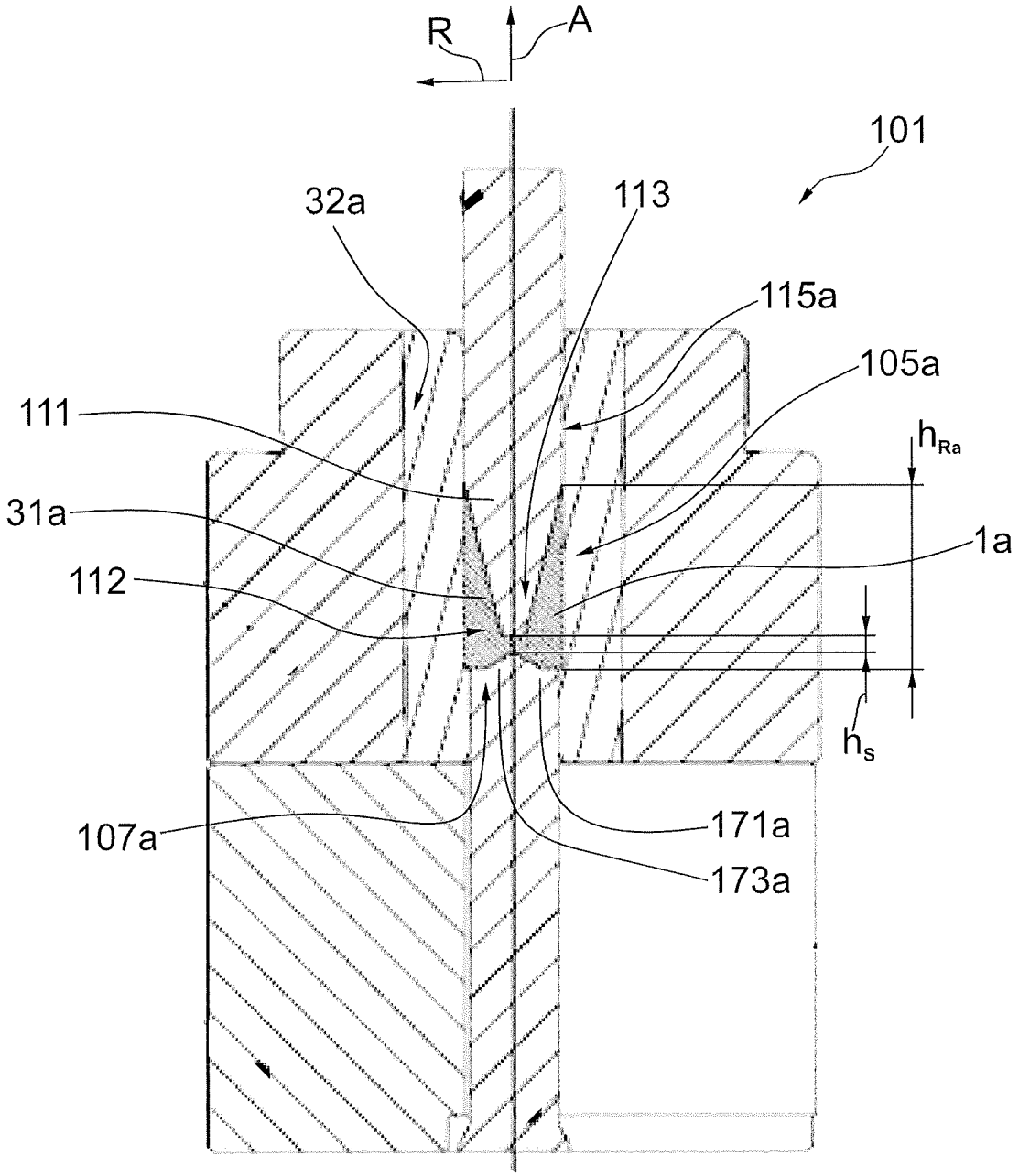
Figure 9B:
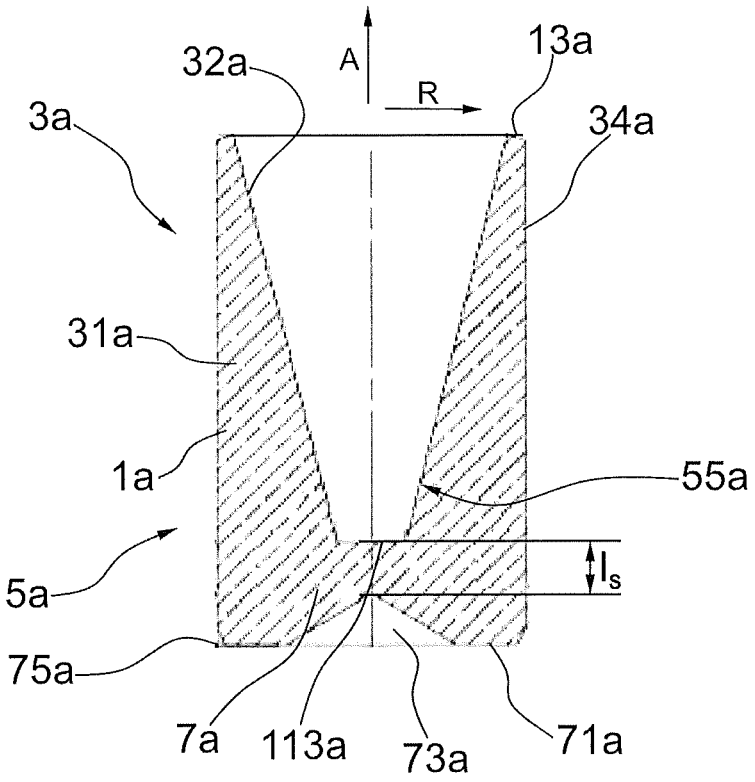
Figure 9C:
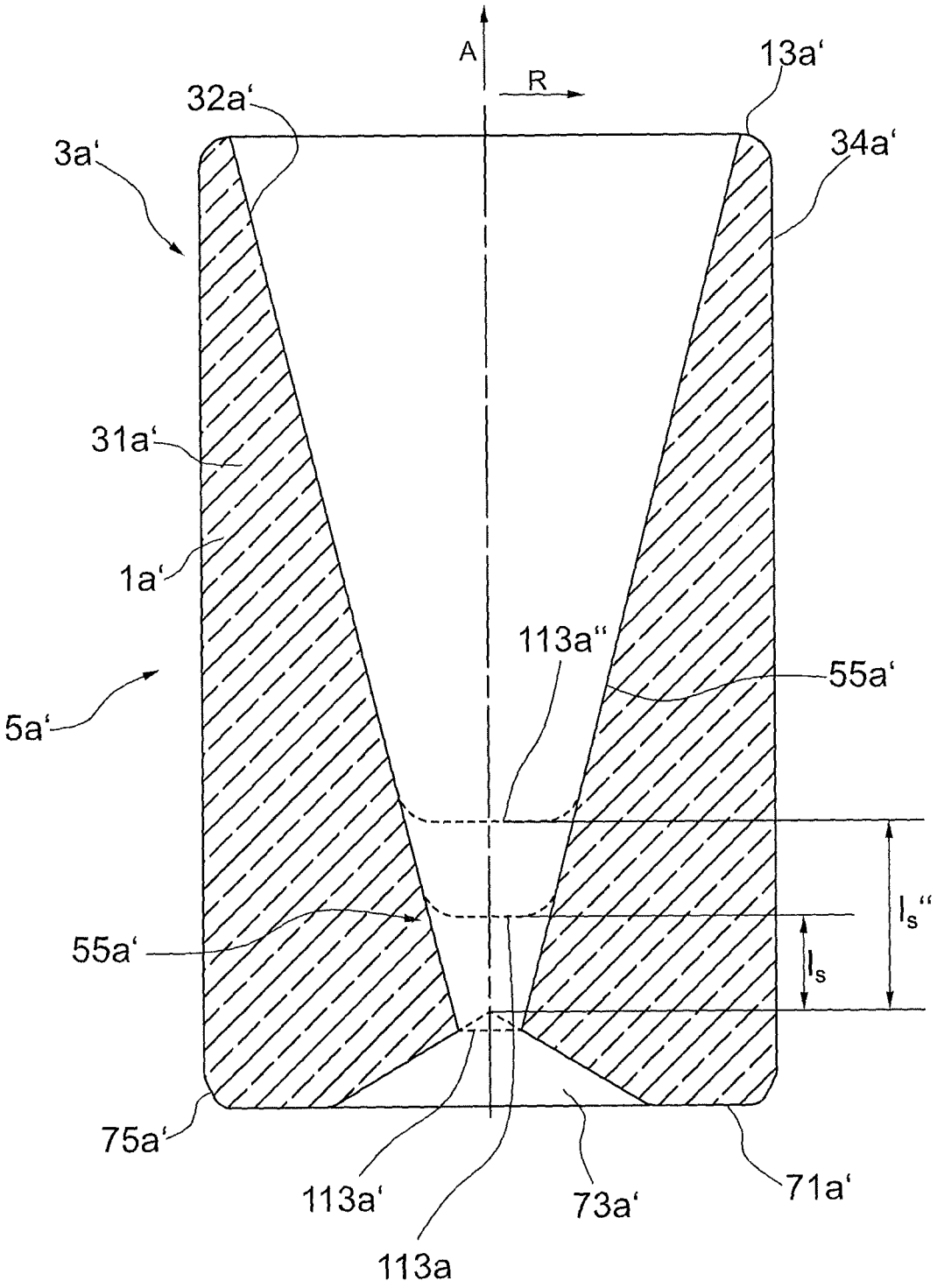
Figure 10A:
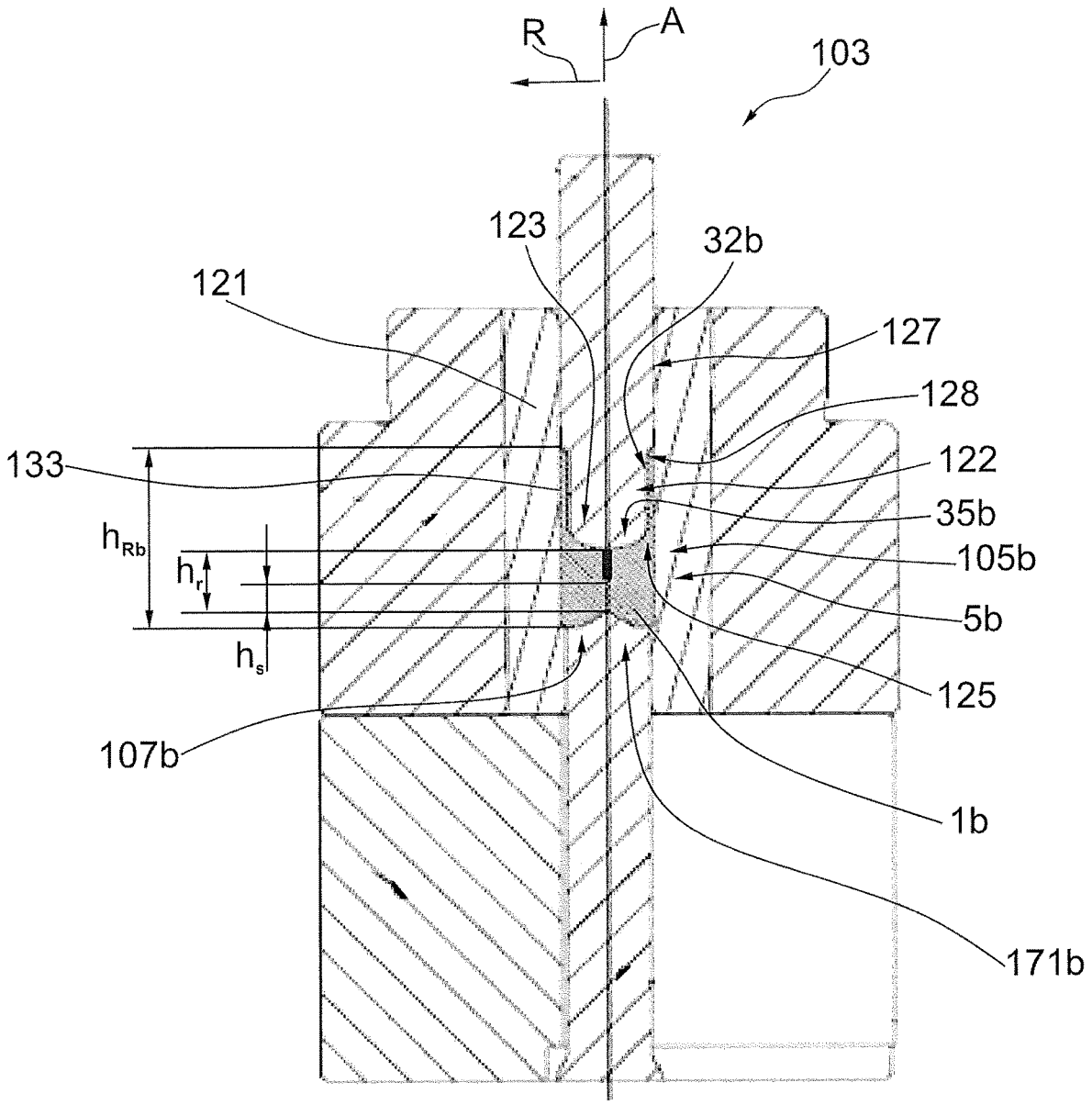
Figure 10B:
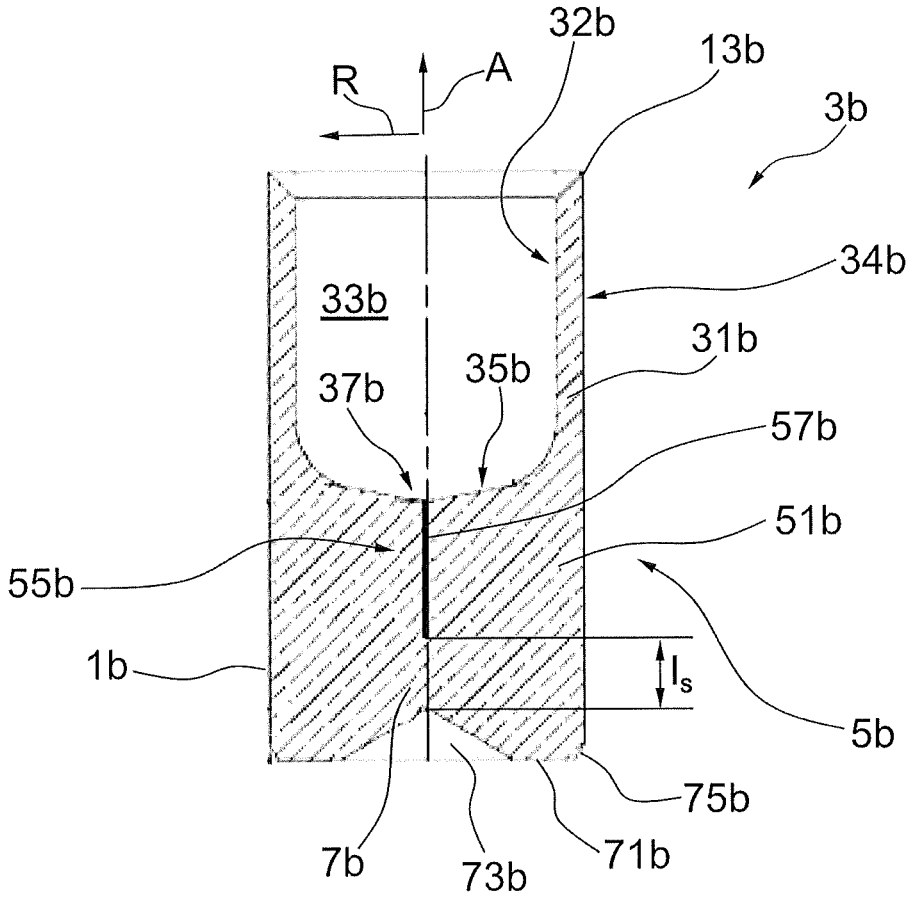

FIG. 9*a* shows a preform press of a tool arrangement according to the invention;

FIG. 9*b* shows a preformed projectile blank;

FIG. 9*c* shows another preformed projectile blank;

FIG. 10*a* shows an inner contour forming press;

FIG. 10*b* shows an internally contoured projectile blank; and

Figure 11:
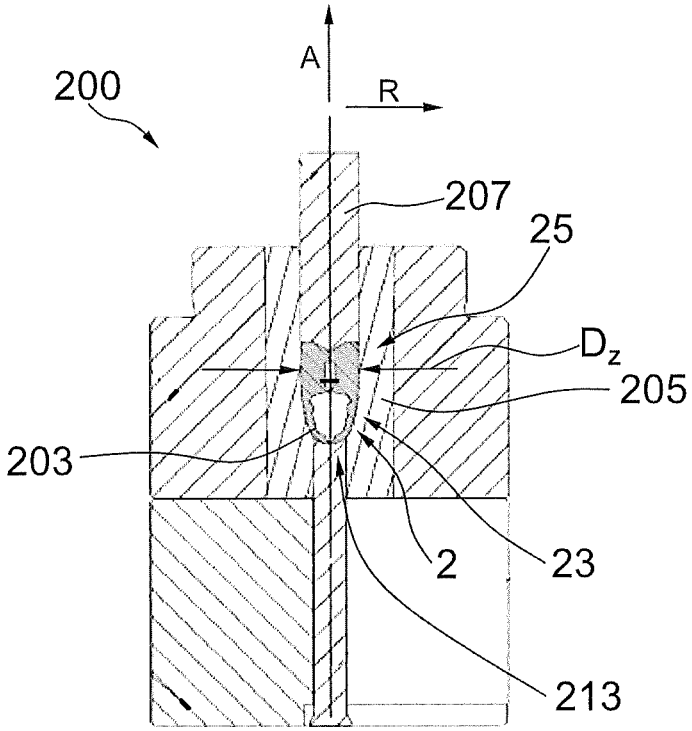

FIG. 11 shows an ogival forming press.

Figure 1B:
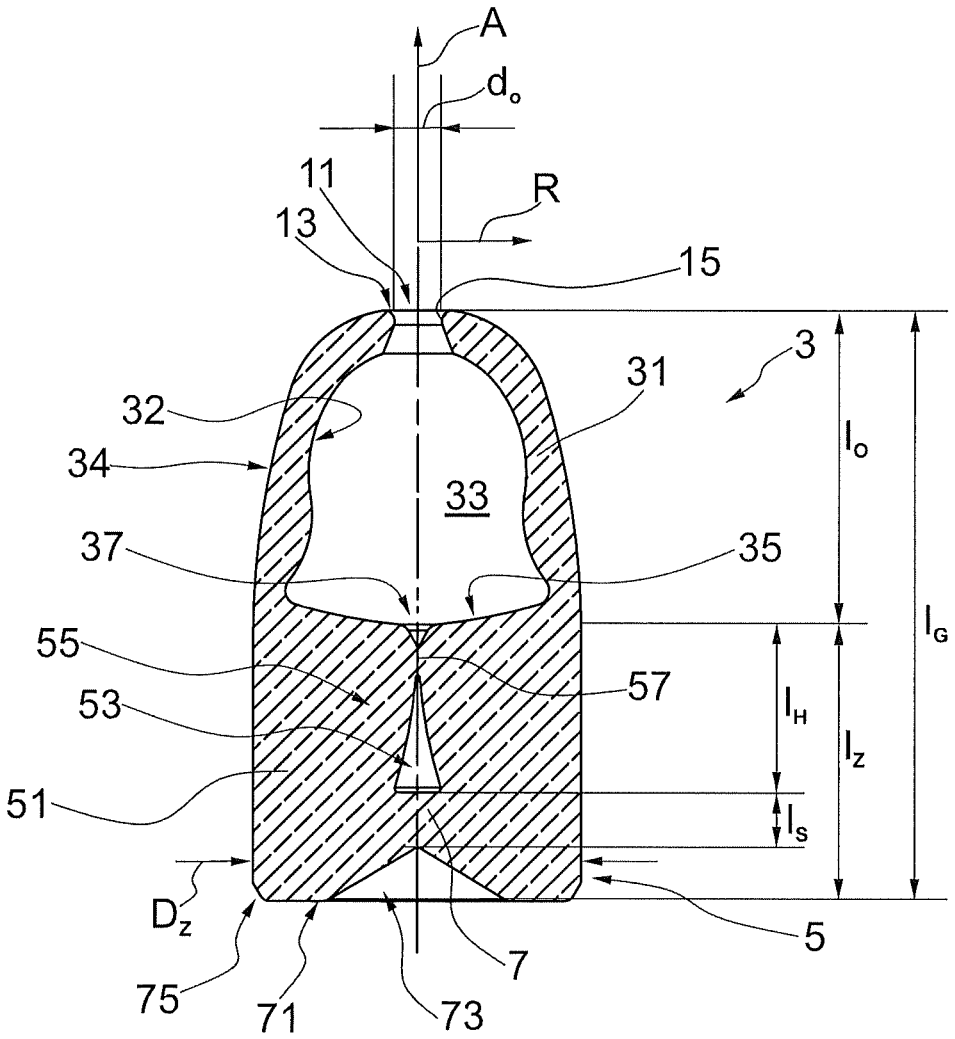
Figure 1A:
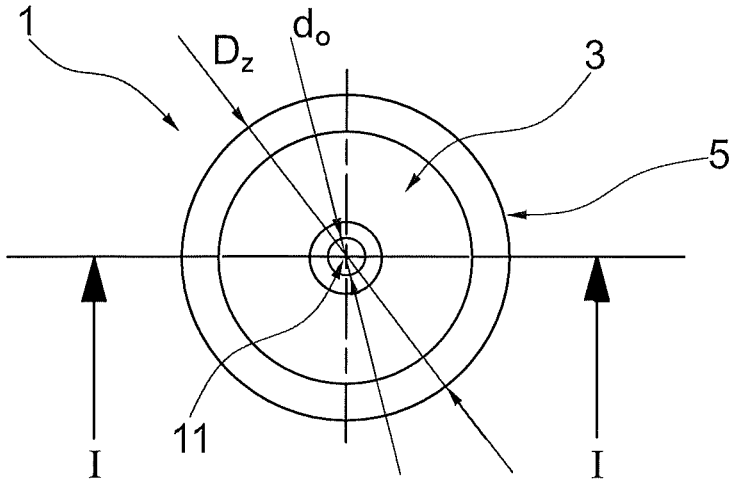

FIG. 1*a* shows a plan view of a solid projectile 1 and FIG. 1*b* a sectional view according to section line I-I. The solid projectile 1 comprises a frontal ogival section 3 and a foot-side cylinder section 5. As can be seen clearly in the sectional view shown in FIG. 1*b*, the solid projectile 1 is made of a single piece of homogeneous material. The material of the solid projectile 1 is preferably copper. The surface of projectile 1 can be provided with a thin coating. In the ogival section 3, projectile 1 has an ogival curved, rotationally symmetrical outer contour 34, which is pierced by a circular opening 11 at the front side 13 of projectile 1. At the tip or front 13 of projectile 1, the opening 11 with the opening diameter $d_O$ is provided concentrically and preferably rotationally symmetrically to the axis of rotation A of projectile 1. Starting from the projectile tip 13, the ogival wall 31 extends like a dome with an ogival outer contour 34. Starting from the projectile tip 13, the outer contour 34 describes in axial direction A a continuously rounded widening ogival shape. Near the apex 3, projectile 1 has a radius of curvature of about 3.1 mm. Close to the cylinder section, the rounding radius of the outer contour 34 is about 23.5 mm.

The opening angle of the outer contour 34 with respect to the axis of rotation A is initially blunt (near the projectile tip 13), so that a blunt projectile tip 13 with an opening angle of 150° to 180°, preferably about 180°, is formed in particular as a result of the frontal opening 11. Starting from the blunt tip 13 of projectile 1, the opening angle of the outer contour 34 of ogival section 3 preferably increases continuously.

In FIG. 1, the solid projectile 1, the opening angle relative to a tangent of the outer contour 34 at an axial distance of about 1 mm from the blunt tip 13 of projectile 1 is between 120° and 140°, especially at about 130°.

At a distance of approximately 2 mm in axial direction A from the blunt tip 13 of projectile 1, the tangential opening angle shall be between 110° and 90°, in particular approximately 100°. In the solid projectile 1 shown in FIG. 1, the ogival outer contour 34 of the ogival section 3 extends in such a way that after approximately 8 mm to 11 mm, preferably between 9 mm and 10 mm, in particular at approximately 9.6 mm, the tangent oriented in axial direction A to the outer contour 34 extends substantially parallel to the axis of rotation A of projectile 1. From this point the outer contour 34 extends in the cylinder section 5 of projectile 1. In the cylinder section 5 the outer contour 34 of projectile 1 runs essentially ideally cylindrical. In cylinder section 5, the outer contour 34 of projectile 1 is arranged essentially parallel to the axis of rotation A of projectile 1. The cylinder section 5 defines the largest diameter $D_Z$, which can be referred to as the projectile diameter or caliber diameter. The outer diameter $D_Z$ of a projectile for a 9 mm Luger caliber training cartridge can measure 9.02 mm. The cylinder section 5 of projectile 1 is intended to be inserted at least partially in axial direction A into the (unrepresented) neck of a (unrepresented) cartridge case.

The cylinder section extends in the axial direction of projectile 1 over 5 mm to 10 mm, preferably between 6 mm and 9 mm, in particular between 7 mm and 8 mm, preferably between 7.2 mm and 7.8 mm, preferably about 7.5 mm.

At the end 71 of projectile 1 remote from the tip or end 13, the projectile 1 has a flat foot section or foot extending transversely, in particular at right angles to the axis of rotation A. A calotte 73 can be inserted in the foot 71 of projectile 1, which is preferably coaxial and concentric to the rotation thing A. The calotte 73 can be inserted in the foot 71 of projectile 1. The calotte 73 is preferably conical and tapers towards the front. A dome 73 tapered at the front can alternatively be dome-shaped or frustoconical. The dome 73 preferably has a depth of 1.5 mm in axial direction A. The dome 73 has a depth of 1.5 mm in axial direction A.

The rear side edge 75 between the flat tail 71 and the cylindrical outer contour 34 in the area of the cylinder section 5 of projectile 1 is preferably realized by a chamfer-like cone section 75. For example, the cone section 75 can extend 1 mm in axial direction A and preferably have an opening angle of about 60°. A cone section 75 can also be formed as a longer and/or more pointed so-called "boat tail" section.

Projectile 1 has a bell-shaped, rotationally symmetrical ogival cavity 33, which is completely surrounded in radial direction R by the ogival wall 31. On the front side, the ogival cavity 33 opens into opening 11 of projectile 1. The narrowest clear width of opening 11 defines an opening diameter $d_O$ which is between 1 mm and 5 mm, preferably about 3 mm. The inner wall 15 of opening 11 surrounds opening 11 in a ring. Preferably, the inner wall 15 forms a ring edge that is free of radial and/or axial steps in the circumferential direction. In particular, the inner wall 15 of the opening 11 can merge into the outer contour 34 of the ogive section 3 without edges and/or completely rounded. As can be seen in the plan view of projectile 1 shown in FIG. 1*a*, the inner wall 15 of opening 11 is uninterrupted in the circumferential direction. The inner wall 15 is preferably free of axially extending notches and/or steps. The tip 13 of projectile 1 is preferably formed by an essentially smooth annular transition from the inner wall 15 to the outer contour 34.

In axial direction A, opening 11 opens into ogival cavity 33. The transition from opening 11 to ogival cavity 33 may preferably be completely rounded. In the depicted configuration of a projectile as shown in FIG. 1*b*, a blunt annular edge with an obtuse opening angle greater than 135° is formed between the ogival cavity 33 and opening 11.

The inner contour 32 of the ogival wall 31, which defines the shape of the ogival cavity 33 circumferentially, is continuously rounded in axial direction A. The inner contour 32 of the ogival wall 31, which defines the shape of the ogival cavity 33 circumferentially, is continuously rounded in axial direction A. In the circumferential direction, the inner contour 32, which surrounds the ogival cavity 33, has no steps, jumps, edges or projections. The ogival wall 31 is circumferentially preferably completely free of axial grooves, projections, notches or the like.

The bottom 35 of the ogival cavity 33 is formed by shoulders 35 projecting radially inwards from the ogival wall 31. The curves of the inner contour 32 preferably merge into the bottom 35 without steps and/or edges, preferably completely rounded. The curves of the inner contour 32 along the ogival wall 31 are preferably formed with radii of curvature which are at least 0.5 mm and up to 5 mm in size. Preferably the inner contour 32 of the ogival wall 31 has radii of curvature which are at least 0.5, at least 0.75 or at least 1 mm in size.

The wall thickness of the ogival wall 31 in radial direction R is preferably between 0.3 mm and 3 mm. In particular, the wall thickness of the ogival wall 31 can be between 0.5 mm and 2 mm. The smallest wall thickness in the radial direction of the ogival wall 31 is preferably more than 0.5 mm, preferably between 1.0 mm and 1.5 mm. At right angles to the wall, the wall thickness can be greater than 1 mm.

A solid projectile 1 according to the invention can have a cavity which comprises the ogival cavity 33 and the opening 11, which in axial direction A extends completely over at least the ogival section 3.

The inwardly projecting shoulder 35 which defines the bottom of the ogive cavity 33 and which preferably completely delimits the ogive cavity 33, in particular in axial direction A on the foot side, may have an opening or mouth 37 in the centre. The height of the ogival section 3 in axial direction A has the reference sign $l_O$. The muzzle 37 is preferably concentric and/or coaxial to the axial direction A. The muzzle 37 has the reference symbol $l_O$. Starting from the muzzle 37, a shaft 55 extends in axial direction A at the foot of the ogive cavity 33 into the cylinder section 5 of projectile 1. The shaft 55 begins at the foot of the ogive cavity 33. The shaft 55 can open with a throat-like opening or muzzle 37 into the ogive cavity 33. Shaft 55 shown in FIG. 1*b* has a microchannel 57 and a deformation cavity 53. In the area of microchannel 57, the diagonally opposite inner chamber edge sections meet. In the area of microchannel 57, a capillary section can be formed in which a channel extends in axial direction A from the ogival cavity 33 at the rear of the projectile, which has a clear width of less than 10 μm or less than 1 μm. Microchannel 57 has a clear width which is preferably considerably smaller than the opening diameter $d_O$ of opening 11 at the tip 13 of projectile 1. Preferably, the clear width of microchannel 57 is smaller than 2 mm, in particular smaller than 1 mm.

For example, the shaft mouth 37 can form a kind of funnel-shaped transition area between shaft 55 and the ogival cavity 33. Preferably, the bottom 35 of the ogival cavity 33, in particular without steps and/or edges, is rounded to the mouth 37. The mouth 37 is preferably rounded and merges into the other sections of shaft 55, e.g. the microchannel 57 and/or the deformation cavity 53.

At the foot of microchannel 57, shaft 55 has a deformation cavity 53 which expands in a conical shape in the rear direction. The deformation cavity 53 has an essentially flat flat end at the rear in axial direction A, which preferably extends transversely, in particular perpendicularly, to axial direction A in radial direction R. In the direction of the tip or front side, the deformation cavity 53 is wedge-shaped, in particular conical, and tapers.

Shaft 55 is rotationally symmetrical at least in sections or in the axial direction with respect to the projectile axis A. In radial direction R, shaft 55 is surrounded by a deformation sleeve wall 51 of projectile 1. The wall thickness of the deformation sleeve wall 51 is greater than the wall thickness of the ogival wall 31. In particular, the smallest wall thickness of the deformation sleeve wall 51 is greater than the largest radial wall thickness of the ogival wall 31. The wall thickness of the deformation sleeve wall 51 can be between half and ¼ of the cylinder diameter (or caliber diameter) $D_Z$. Preferably the wall thickness of the deformation sleeve wall 51 is greater than ⅔, greater than ¾ or even greater than 90% of half the (caliber) cylinder diameter $D_Z$.

The wall thickness of the ogival wall in the axial area of the ogival cavity 33 is preferably smaller in the middle than ¼ of the (caliber) cylinder diameter $D_Z$.

The axial height $l_H$ of the deformation sleeve wall 51 surrounding the shaft 55 extends in the axial direction between 5 and 10 mm, preferably between 6 and 9 mm, in particular between 7 and 8 mm, preferably starting from the shoulder bottom 35 of the ogive cavity 33. The axial height of the deformation cavity 53 is greater than the length of the microchannel section 57. In particular, the axial height of the deformation cavity 53 can be at least twice the axial height of the microchannel 57.

The cylinder section 5 extends from the foot or tail 71 of the projectile to the ogival section 3 over 3 mm to 10 mm (height $l_Z$), preferably between 4 mm and 8 mm, in particular over about 6 mm.

The calotte preferably has an outside diameter of 4 to 6 mm at the rear, in particular 5 mm. Instead of the truncated cone section 75 shown, the edge between the tail 71 and the cylindrical outer contour 34 in the region of the cylindrical section 5 may be completely rounded with a radius of curvature between 0.3 and 1.5 mm, preferably between 0.4 and 1 mm. Since a deformation cavity 53 widening at the rear is provided in the cylinder section 5 and, if necessary, a calotte 73, it can be achieved that the center of gravity of projectile 1 is shifted in axial direction A in the direction of the front side of projectile 1. The deformation cavity 53 and, if necessary, the calotte 73 serve or serve as mass compensation relative to the ogival cavity 33 provided on the front side. By adjusting the axial balance of the projectile's center of gravity, its flight characteristics can be optimized. For example, a projectile according to the invention can be designed for training cartridges to achieve similar ballistic properties, such as weight, if necessary center of gravity, and/or shooting sensation, according to standard training cartridges or training cartridges, for example the 9×19 ACTION 4 ammunition.

The solid projectile 1 depicted in FIG. 1*b* and FIG. 1*a* has a solid, fully cylindrical projectile stem 7 or stem section, respectively, in which the projectile is formed in axial direction A in the form of a solid, in particular cavity-free solid cylinder. The stem 7, in particular in the middle, coaxial to the projectile axis A, has no cavity, in particular no cavity which extends axially in the form of a thin capillary channel with the formation of inner edges. Preferably, the fully cylindrical stem 7 has an ideal cylindrical outside. In an alternative embodiment of a projectile with a boat tail, the stem 7 can be truncated conically on the outside at least in sections. In a transverse section, especially perpendicular to the axis of rotation A of projectile 1, the stem cross-section 7 is circular. The height of the stem 7 between the stern 71 or a calotte 73 formed in the stem 71 and the stem end of the deformation cavity 53 (stem height $l_S$) is less than 5 mm, preferably less than 3 mm, in particular less than 2 mm or less than 1 mm. According to an alternative configuration of a projectile according to the invention, the projectile may be fully penetrated in the axial direction without the use of a stem. Such projectiles are described in more detail below.

FIGS. 2 to 6 show different alternative configurations of solid projectiles for practice cartridges according to the invention. The solid projectiles depicted in FIGS. 2 to 6 largely correspond to the solid projectile depicted in FIG. 1*b*. The solid projectiles of FIGS. 2 to 6 differ from the solid projectile 1 as shown in FIG. 1*b* in the type, shape and size of the shaft extending from the ogive cavity into the cylindrical section of the projectile. The solid projectiles of FIGS. 1*b* to 6 have practically the same outer contour, in particular the same dimensions in axial direction A and/or radial direction R. For easier legibility of the figure description, the same or similar reference signs are used below for FIGS. 2 to 6 for similar or identical parts of the solid projectile according to the invention.

Figure 2:
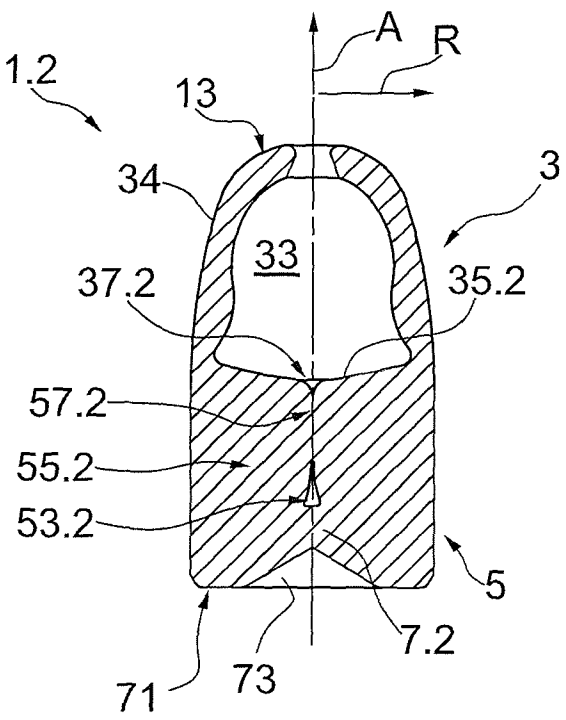
FIG. 2 shows a sectional view of another solid projectile according to the invention.

FIG. 2 shows a solid projectile 1.2 which differs substantially from the solid projectile 1 as shown in FIG. 1*b* in that the inner walls of shaft 55.2 are joined in axial direction A over a greater length than the axial height of the deformation cavity 53.2.

The axial height of the microchannel section 57.2 is greater than the axial height of the deformation cavity 53.2, in particular at least twice as large. At the solid projectile 1.2 the shaft 55.2 has a throat-like mouth 37.2, which widens funnel-shaped from the micro channel 57.2 to the bottom 35.2 of the ogival cavity 33. Between the foot end of the conically tapering deformation cavity 53.2 at the front and the calotte 73 at the foot 71 of projectile 1.2, projectile 1.2 has a stem 7.2. The axial height of the stem 7.2 is greater than the axial height of the deformation cavity 53.2. A deformation projectile 1.2 as shown in FIG. 2 may be produced, for example, by producing a deformation projectile 1 as shown in FIG. 1*b* according to a target specification, but more metal material is provided for production. The excess material compared to the shape of the solid projectile 1 is tolerated in the case of the solid projectile 1.2 by the fact that the opposite inner side sections of the shaft 55.2 are pushed closer together in the radial direction R. The deformation projectile 1 is a solid projectile 1.2.

Figure 3:
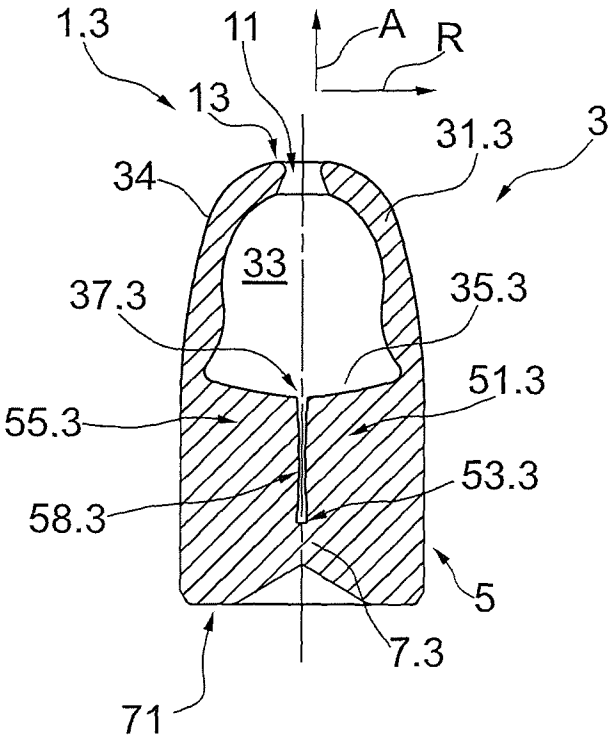
FIG. 3 shows a sectional view of another solid projectile according to the invention.

FIG. 3 shows a solid projectile 1.3 with a tubular shaft 55.3. The shaft 55.3 of the solid projectile 1.3 forms a deformation tube 58.3 extending in axial direction A coaxial to the axis of rotation A of the solid projectile 1.3 with a substantially constant clear width. The deformation tube 58.3 may have a constriction in the axial direction. Shaft 55.3 has a deformation cavity 53.3, which extends essentially over the entire length of shaft 55.3 to its mouth 37.3. The deformation tube 58.3 or the microchannel of the solid projectile 1.3 can be regarded as a cylindrical deformation cavity 53.3 in sections, which merges into the ogive cavity 33 at the mouth 37.3. The deformation sleeve 51.3 of the solid projectile 1.3 therefore has a cylindrical outer side and a nearly cylindrical, waisted inner side, which defines the deformation tube 58.3. The largest clear width of the deformation tube 58.3 is smaller than the clear width of the front opening 11, in particular narrower than half, preferably narrower than ¼ of the clear width. The wall thickness in radial direction R of the deformation sleeve 51.3 is greater than the mean wall thickness of the ogival sleeve 31.3.

Figure 4:
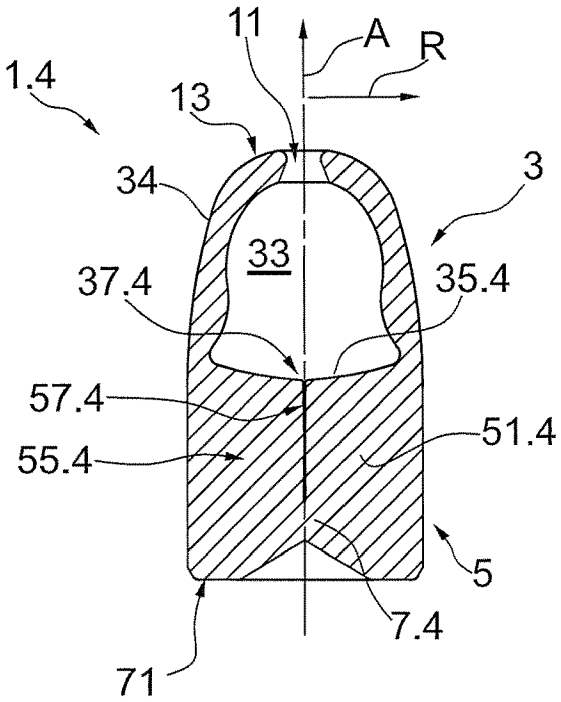
FIG. 4 shows a sectional view of another solid projectile according to the invention.

FIG. 4 shows a solid projectile 1.4 for an exercise cartridge, in which the shaft 55-4 is shaped in axial direction A to form a stem 7.4 of similar length to the shaft 55.3 of the solid projectile 1.3 according to FIG. 3. The shaft 55-4 is narrowed along its entire axial length to a microchannel 57.4, which preferably extends capillary-like from the mouth 37.4 into the cylinder section 5 of the solid projectile 1.4. The clear width of the microchannel 57.4 is preferably smaller than 1/10, in particular smaller than 1/100 of the clear width of the front opening 11 of the solid projectile 1.4. The shoulders 35.4 of the solid projectile 1.4 are guided together in such a way that the mouth 37.4 of the shaft 55.4 is narrowed point-like. The solid projectile 1.4 is formed with practically complete dissolution of the deformation cavity. This can be regarded as a further narrowing of shaft 55.4 in comparison with shaft 55.2 of solid projectile 1.2 or shaft 55 of solid projectile 1. Compared to the solid projectiles 1, 1.2 and 1.3, the solid projectile 1.4 has an increased solid material volume, since the cylinder section 5 of the solid projectile 1.4, despite the formation of a deformation sleeve section 51.4, has practically the same mass as the solid projectile known from the state of the art (which, however, does not have a deformation sleeve 51.4).

Figure 6:
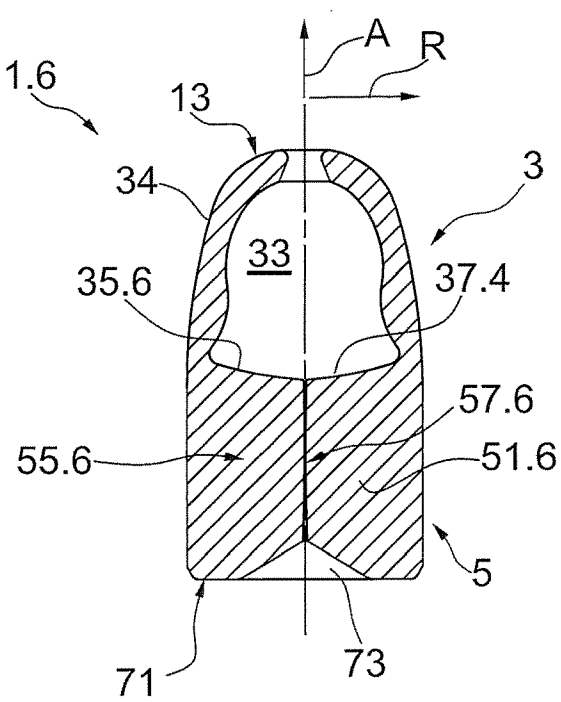
FIG. 6 shows a sectional view of another solid projectile according to the invention.
Figure 5:
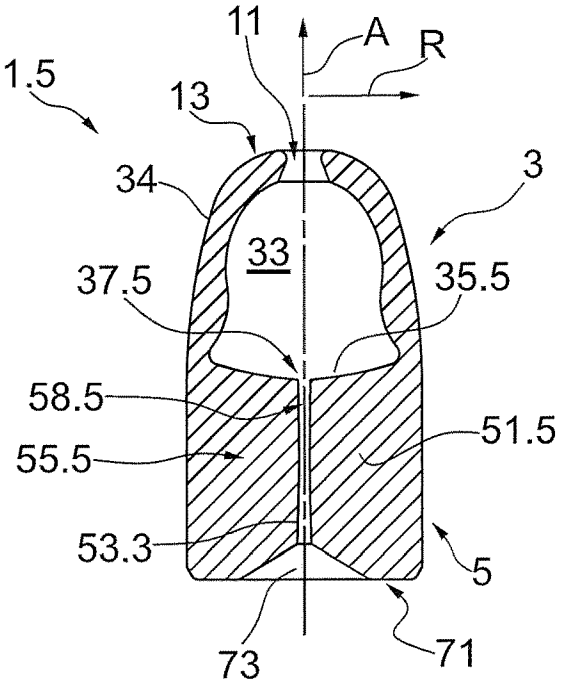
FIG. 5 shows a sectional view of another solid projectile according to the invention.

Compared with the solid projectiles 1, 1.2, 1.3 and 1.4 shown in FIGS. 1*b* to 4, the solid projectiles 1.5 and 1.6 shown in FIGS. 5 and 6 differ in that the shaft 55.5 and 55.6 penetrates the cylinder section 5 of projectile 1.5 and 1.6 respectively completely. The solid projectiles 1.5 and 1.6 do not have a cylindrical stem section. In other words, a fully cylindrical stem section has zero height in the solid projectiles 1.5 and 1.6 shown in FIGS. 5 and 6, respectively.

The solid projectile 1.5, shown in FIG. 5, has a tubular shaft 55-5 with a clear width which is almost constant in the axial direction and which extends completely through the cylinder section 5. As a result of the continuous deformation tube 58.5 of the solid projectile 1.5, the cylinder section 5 is completely realized as deformation sleeve 51.5. The deformation tube 58.5 can be regarded as a deformation cavity 53.5 or shaft 55.5, which essentially extends cylindrically from the mouth 37.5 to the dome 73 of the solid projectile 1.5. It is clear that a shaft 55.5 penetrating completely into the projectile can also extend to the rear 71 of projectile 1.5 if no calotte 73 is provided at the rear of projectile 1.5 (not shown). The same applies to shaft 55.6 as shown in FIG. 6. The projectile 1.5 may be described as a completely sleeve-shaped solid projectile. It has a continuous axial channel consisting of the front opening 11, the ogival cavity 33 and the deformation tube 58.5. The smallest clear width of this axial channel corresponds to the smallest clear width of the deformation tube 58.5. The smallest clear width of the deformation tube 58.5 or the microchannel of the solid projectile 1.5 defines a diameter smaller than that of the front opening. The smallest clear width of the deformation tube 58.5 is preferably smaller than 2 mm, in particular smaller than 1 mm, in particular preferably smaller than 0.5 mm. The largest clear width of the deformation tube 58.5 is preferably realized at its transition to the ogival cavity (the mouth 37.5) and/or the opening on the calotte or rear side and preferably measures less than 2 mm, in particular less than 1 mm. Preferably, the radial difference between the smallest clear width and the largest clear width of the 58.5 deformation tube penetrating the cylinder section 5 is less than 0.5 mm, preferably less than 200 μm, in particular less than 100 μm.

With respect to the solid projectile 1.6 shown in FIG. 6, shaft 55.6, which completely penetrates cylinder section 5 in axial direction A, is tapered section by section to a microchannel 57.6. The microchannel 57.6 can preferably be capillary-like with a clear width of less than 10 μm, preferably less than 1 μm. Preferably, the capillary-like narrowed section of the microchannel 57.6 extends over at least half, preferably at least ⅔, in particular at least ¾, of the axial length of the shaft 55.6. The shaft 55.6 can be widened on the front side, at the mouth 37.6, and/or on the rear side, at the mouth to the calotte 37 or the projectile tail 71, to form a tube-like or tube-like microchannel 57.6. with a larger internal width. Similar to the solid projectile 1.4 shown in FIG. 4, the solid projectile 1.6 has practically the same mass as the solid projectile for practice cartridges known from the state of the art (which, however, has no deformation case 51.6 or the like).

Figure 7:
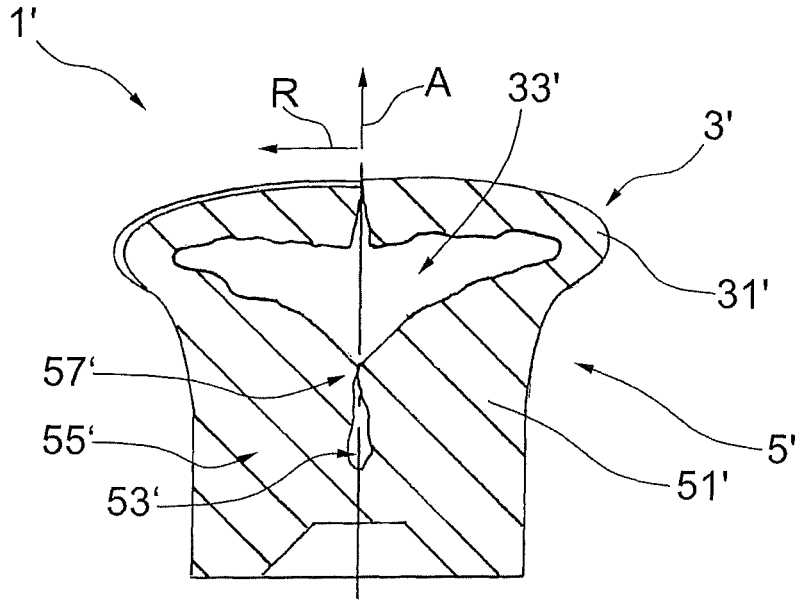
FIG. 7 shows a schematic cross-sectional view of a used solid projectile according to the invention.

FIG. 7 shows a schematic cross-sectional view of a solid projectile 1', in accordance with the invention, after its impact on a target, a projectile-proof vest, like a ballistic vest of protection class I. The solid projectile 1', deformed by the impact, is clearly compressed both in the area of the ogive section 3' as well as in the area of the cylinder section 5'. The shaft 55' extending into the cylinder section 5' of the solid projectile 1' is widened by the impact of the projectile 1' on the target or the like under plastic deformation. In contrast to the known solid projectiles, the plastic deformation takes place in the form of a buckling and over a significantly increased axial length in axial direction A of the solid projectile 1', so that the kinetic energy of the invented solid projectile is converted into plastic deformation energy at a relatively higher degree of efficiency when it hits a resistance than with conventional projectiles. The impact with a resistor, especially a soft target such as SK I, results in only a slight transverse deformation of the projectile. Preferably, the ogival case wall 31 folds radially outwards on impact. During folding, a radially outermost ring bend 31' can form. Preferably, the projectile will not mushroom in the radial direction outwards as the projectile tip moves, especially beyond the radial caliber diameter. On impact with the resistor, the 55' shaft expands in the radial direction R both in the area of the possibly existing 57' microchannel section and in the area of a possibly existing 53' deformation cavity. With respect to solid projectile 1' according to the invention, both the ogival sleeve wall 31' and the deformation sleeve wall 51' are deformed.

The solid projectiles described above according to the preferred embodiments of FIGS. 1 to 7 concern solid projectiles for practice cartridges according to the 9 mm Luger caliber, which is particularly common in Germany and is also known as 9 mm Para or 9×19 (mm). It is clear to the person skilled in the art that he can also produce a corresponding projectile geometry for a solid projectile according to the invention for other calibers. The person skilled in the art knows how to scale the projectile length $l_D$ and/or the (caliber) projectile diameter $D_Z$ for this purpose in order to arrive at a corresponding solid projectile of other calibers according to the invention, for example the caliber .357 Mag., the caliber .40 S&W, the caliber .44 Rem. Mag. or the .45 ACP caliber.

In the following, with the aid of FIGS. 8 to 11, a tool arrangement in accordance with the invention for carrying out a manufacturing method in accordance with the invention for the manufacture of metallic solid projectiles for practice cartridges in accordance with the invention is described.

Figure 8:
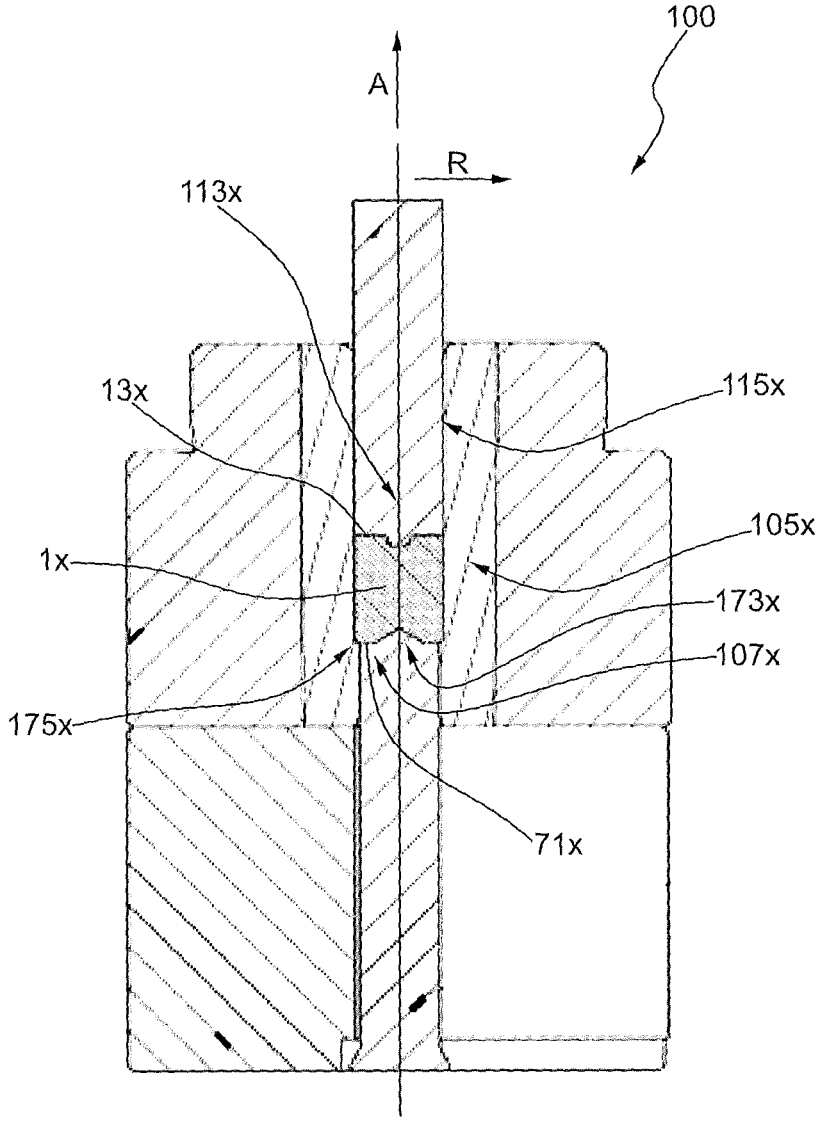
FIG. 8 shows a setting press of a tool arrangement.

FIG. 8 shows a setting press 100, which can be part of a tool arrangement according to the invention. The setting press 100 has as essential components a metal blank receptacle 105*x*, a rear punch with a bottom side 107*x* and a setting punch 115*x*. The setting punch 115*x* preferably has a cylindrical outer diameter which essentially corresponds to the inner diameter of the metal blank receptacle 105*x*. The inner diameter of the 105*x* metal blanks receptacle is preferably dimensioned according to the desired caliber diameter of the projectile to be produced.

FIG. 8 shows a setting press 100 in a position in which the setting punch 115 is arranged in its widest position in operation with respect to the bottom side 107*x* or the metal blank receptacle 105*x* (setting end position). A cavity is formed between the front side 113*x* of the setting punch 115*x*, the cylindrical inner side of the metal blank receptacle 105*x* and the bottom side 107*x*, in which a metal blank 1*x* is located. The metal blank 1*x* shown in FIG. 8 has a centering punching, which is inserted by a centering projection of the setting press 100 at the front 13*x* of the metal blank 1*x*. At the rear side 71*x* of the metal blank 1*x* opposite its front side 13*x* the fully cylindrical metal blank 1*x* has a dome like indentation in the middle and concentrically by a correspondingly formed, cone-shaped calotte form nose 173*x* at the bottom side 107*x*, thus the front side of the rear punch. Radially on the outside, the metal blank 1*x* has a phase-like truncated cone section 75*x* on its rear side 71*x*, which is arranged in the edge area between the rear 71*x* and the cylindrical circumferential side 5*x* of the metal blank 1*x*. The phase side truncated cone section 75*x* is defined by corresponding taper in the transition area between the rear punch and the cylindrical inner wall of the setting die 105*x*.

For the setting forming of the metal blank 1*x* in the setting press 100, an essentially cylindrical metal blank (not shown) is first provided, which was cut to length, for example, from a copper wire. Cutting to length can be done by cutting, for example by sawing or milling, or without cutting, for example by punching or cutting. The cut-to-length metal blank is then placed in the 105*x* metal blank receptacle. The setting punch 115*x* is then moved relative to the bottom side 107*x* until the cavity between the setting punch 115*x*, the die or metal blank receptacle 105*x* and the bottom side 107*x* is reduced to the setting end position shown in FIG. 8. The bottom side 107*x* of the press is formed by the top face of a rear punch. In the setting press, the metal blank is formed into the 1× metal blank shown in FIG. 8 by press forming, i.e. cold forming. The setting of the metal blank which is used for forming into a projectile, especially in a setting press 100, is an optional step of the manufacturing method according to the invention. A metal blank can also be supplied to a preforming press or for a preforming step immediately after cutting to length from a metal wire, such as a copper wire, without a previous setting step.

FIG. 9*a* shows a preform press 101 of a tool arrangement according to the invention. FIGS. 9*b* and 9*c* show projectile blanks 1*a*, 1*a*' (first stage) manufactured in a preform press.

The preform press 101 has as essential components a hollow-cylindrical projectile blank receptacle 105*a* as well as a bottom side 107*a*, which limits the projectile blank receptacle 105*a* in axial direction A, and a preform punch 111 with a preform section 112 which tapers in axial direction to a frustoconical front surface 113. The preform die 111 has a cylindrical guide section 115, which is complementary in shape to the cylindrical inner diameter of the projectile blank receptacle 105*a*, in order to guide the preform die during the preform pressing method. The bottom surface 107*a* is formed as part of a rear punch. The ejection punch or rear punch defines, preferably together with the lower end portion of the preform die 105*a*, the geometry of the rear 71 (with calotte 73 if necessary) of the projectile blank 1*a*, 1*a*' (first stage).

FIG. 9*a* shows the preform press 101 with the preform punch 111 in the operational end position (preform end position), in which a preform cavity for defining the inner and/or outer contour of the projectile blank 1*a* (first stage) is defined between the preform punch, the projectile blank receptacle 105*a* and the base side 107*a*. To form a rotationally symmetrical ogival cavity, the preform section 112 of the preform punch 111 is formed in the presence of a truncated cone shape and rotationally symmetrical. In the preform end position shown in FIG. 9*a*, an axial distance $h_s$ is formed between the bottom 107*a* and the front surface 113 of the preform punch 111. In the version shown in FIG. 9*a*, the base 107*a* has a dome-shaped nose which, starting from a flat, ring-shaped base, extends axially into the cavity. The preform axial distance $h_s$ or the preform stem height $h_s$ is measured in this configuration of the preform press between the tip of the calotte form nose 171*a* of the rear punch and the front surface 113 of the preform punch 111. In another configuration (not shown) of a preform press 101, in which the bottom 107*a* is configured without calotte form nose 173*a*, the preform stem height $h_s$ would extend between the flat foot form section 171*a* of the rear punch and the front surface 113 of the preform punch 111.

The preform punch 111 has a tapered preform section 112, which leads into a front surface 113. The front surface 113 can be very narrow. The preform section 112 according to FIG. 9*a* has the shape of a truncated cone that is rotationally symmetrical to axis A. The preform section 112 can be very narrow. Other rotationally symmetrical tapering shapes, such as a parabolic shape or a sectionally rounded shape, are conceivable. The base of the preform section 112 has the same outer diameter as the guide section 115 of the preform punch 111. In the preform end position shown in FIG. 9*a*, between the base of the preform section 112 and the rear surface 171*a* of the bottom side 107*a*, or the largest height of the cavity $h_{Ra}$, is formed. The largest cavity height $h_{Ra}$ in the preform press 101 extends between the rear surface 171*a* and the point furthest away from the foot surface 171*a*, at which the preform section 112 of the preform punch 111 preferably meets the inside of the hollow-cylindrical projectile blank receptacle 105*a*. In accordance with the invention, in the preform end position a stem height corresponding to the axial distance $h_S$ is less than 45%, preferably less than 40%, in particular less than 25%, more preferably less than 10%, of the cavity height $h_{Ra}$. The length of the preform section 112 in axial direction A starting from the front surface 113 of the preform punch 111 is between 5 mm and 25 mm, preferably between 8 mm and 17 mm, in particular between 10 mm and 15 mm, in particular preferably between 13.5 mm and 14 mm. The diameter of the front surfaces is preferably between 1 mm and 3 mm, in particular around 2 mm.

The tool arrangement for the setting press 100 and the preform press 101 according to the invention can use the same projectile blank receptacle 105*a* or metal blank receptacle 105*x* (same die) and/or the same bottom side 107*a* or 107*x* (same rear punch). In the case of a tool arrangement in accordance with the invention, the blank receptacle 105*a* or 105*b* (the die) and/or the bottom surface 107*a* or 107*b* (the rear punch) of the preforming press 101 and the inner contour forming press 103 may be the same. The setting press 100, the preforming press 101, the inner contour forming press 103 and/or the ogival forming press 200 can be partially or completely different from each other by an individual setting station, preforming station, inner contour forming station and/or ogival forming station.

The metal blank located in the preform press 101 by pressing punch 111 in the projectile blank receptacle 105*a* produces the first stage 1*a* projectile blank, as shown in FIG. 9*b*. A stem height $l_s$ remains between the truncated end 113*a* of the angular truncated inner contour 32 and the rear end 71*a* or the dome recess 73 formed therein. The stem height $l_s$ extending in axial direction A essentially corresponds to the preform axial distance $h_s$ according to FIG. 9*a*, whereby metal material settling phenomena of the projectile blank 1*a* must be taken into account. In the axial area of the stem height $l_3$, the projectile blank 1*a* is formed with a fully cylindrical stem section 7*a*. In the fully cylindrical stem section 7*a*, the projectile blank 1*a* has a massive fully circular cross-section transversely to the axial direction A. The cross-section of the projectile blank 1*a* is the same as in the fully cylindrical stem section 7*a*. The stem section 7*a* of projectile blank 1*a* is formed on the foot side or rear side (away from the front 13*a*) of projectile blank 1*a*. The outer contour 34*a* of the projectile blank 1*a* is essentially ideal cylindrical and preferably has an outer diameter corresponding to the projectile cylinder diameter $D_Z$. Preferably the projectile diameter $D_Z$ is produced in the metal or projectile blank before it is prepared in the forming press 101, and the outer diameter of the projectile remains constant at least in sections in the preforming press 101 (and possibly the inner contour forming press 103 and/or the ogival forming press 200). In particular in cylinder section 5*a* (or 5, 5*b*) of the projectile blank 1*a* (1, 1*b*), the projectile outer diameter remains constant until the end of the manufacturing method after the metal or projectile blank has been provided in the preform press.

The wall thickness of the sleeve section 3*a* of the projectile blank 1*a* increases continuously from the front 13*a* of the projectile blank 1*a* to its rear 71*a*, preferably continuously, especially continuously. In the front case section 3*a*, the (mean) wall thickness of the case wall 31*a* in radial direction R is smaller than the (mean) wall thickness of the case wall 31*a* in cylinder section 5*a*. The frustoconical recess 55*a* in the projectile blank 1*a* has an inner contour 32*a* which corresponds essentially to the outer contour of the preform punch 111 (whose preform section 112 and front surface 113). When using a die 111 (not shown) of a shape other than a truncated cone shape, the cavity recess 55*a* of the projectile blank 1*a* will have a different inner contour complementary in shape to the respective tapered die.

FIG. 9*c* shows an alternative embodiment of a projectile blank 1*a*' (first step), where different inner contour blunt ends 113*a*, 113*a*', 113*a*" are shown. The line depicted blunt end 113*a* of the 55*a*" inner contour of the projectile blank corresponds to the depiction according to FIG. 9*b*. The dashed die ends 113*a*' and 113*a*" show that in axial direction A at the rear die ends of the puncture cavity 55*a*' have a greater axial length (die end 113*a*') or a shorter axial length (die end 113*a*") when using a forming punch which is essentially shaped as the forming punch shown in FIG. 9*a*.

According to the dotted line 113*a*', the projectile blank 1*a* is completely penetrated in axial direction A, so that the projectile blank 1*a*' is completely sleeve-shaped. The 55*a*' puncture opening merges with the 73*a*' calotte nose. It is clear that a suitably adapted preform press with a truncated cone-shaped calotte nose must be used to form such a form. The inner contour 32*a*' of the case wall 31*a*' of the projectile blank 1*a* shown in FIG. 9*c* preferably increases continuously, especially continuously, up to the point (113*a*') where the shaft opening 55*a*' of the projectile blank 1*a* merges into the spherical recess 73*a*'. The fully penetrated projectile blank 1*a* shown in FIG. 9*c* does not have a fully cylindrical projectile blank stem. The projectile blank 1*a* is formed free of a projectile stem or with a projectile stem of height zero. Even with a completely penetrated projectile blank 1*a*, other than frustoconical preform punches can be used.

FIG. 9*c* also shows in dashed form another possibility for forming a projectile blank with an enlarged stem with a stem height $l_{s''}$ compared to the projectile blank 1*a* depicted in FIGS. 9*a* and 9*b*.

FIG. 10*a* shows an inner contour forming press 103 and FIG. 10*b* shows a projectile blank 1*b* (second stage) produced with the inner contour forming press 103 shown in FIG. 10*a*. Like the setting press 100 described above and the preform press 103 described above as well as the ogival forming press described below, the inner contour forming press shown in FIG. 10*a* is formed with essentially rotationally symmetrical tools for forming rotationally symmetrical solid projectiles for practice cartridges. The main components of the inner contour forming press 103 are the inner contour forming punch 121, the bottom side 107*b* axially arranged opposite the inner contour forming punch 121 and the hollow cylindrical projectile blank receptacle 105*b*.

In the final position of the inner contour form, which is shown in FIG. 10*a*, the inner contour form punch 121 delimits a cavity on the front side and the bottom side 107*b* or the front side 107*b* of the rear punch on the foot side for the projectile blank 1*b*. The cavity for the projectile blank 1*b* is externally limited in radial direction R by the ideal hollow cylindrical matrix 105*b*. To achieve the inner contour end position shown in FIG. 10*a*, the inner contour forming punch 121 is pressed into the projectile blank 1*a* previously preformed in the preform press 103 until the projectile blank 1*b* second stage is formed, as shown in FIGS. 10*a* and 10*b*, for example.

The inner contour forming punch shown in FIG. 10*a* has an inner contour forming portion 122 which is formed in sections in the axial direction A as a cylindrical sleeve forming portion 133. The cylindrical sleeve shape section 133 of the inner contour forming punch 121 and the inner side of the inner contour outer die 105*b* opposite the sleeve shape section 133 in the radial direction R define the cylindrical wall shape and the wall thickness of the end sleeve wall 31*b*. It is clear that the sleeve mold section 133 can be formed with a slight demolding slope, preferably less than 1°.

The front surface 123 of the inner contour forming punch 121 can be formed as a blunt cone tip with an opening angle between 130° and 180°, preferably about 160°, and rounded front rim edges 125. The blunt cone tip 123 of the inner contour forming punch 121 forms the inner contour 32*b* of the case section 3*b* of the projectile blank 1*b* (second stage), which, starting from the case wall 31*b*, extends in a shoulder-like manner in the radial direction R inwards in order to delimit the base 35*b* of the projectile blank main cavity 33*b* in the axial direction on the foot side. The rounding radius of the front surfaces 123 can be 1 mm to 3 mm, preferably 2 mm. The cylindrical sleeve forming section 133 may also begin about 1 mm, preferably from about 2 mm, in particular from about 2.5 mm, starting from the tip of the inner contour forming punch and extend to about 11 mm, preferably to about 10 mm, in particular to about 9 mm, starting from the tip of the inner contour forming punch 121.

The inner contour forming punch 121 has a guide section 127 which extends in the axial direction immediately adjacent to the forming section 122 far from the front end 123 and which is preferably formed substantially complementary to the hollow cylindrical inner side of the projectile blank receptacle 105*b*. The guide section 127 of the inner contour forming punch 121 can be used to safely guide the forming punch in the inner contour forming die 105*b*, in particular during the relative movement of the punch 121 relative to the bottom side 107*b*.

A preferably frustoconical transition section 128 extends in the axial direction A and in the radial direction R between the inner contour shaping section 122 or its sleeve shaping section 133 and the guide section 127 of the inner contour shaping punch 121. It is clear that the transition section 128 merges in the axial direction directly into the guide section 127 and the inner contour shaping section 122.

From the front end of the inner contour punch guide portion 127 formed by the outer annular edge of the transition portion 128 opposite the rear surface 171*b*, the bottom side 107 of the rear punch, the maximum axial height of the cavity ($h_{Rb}$) extends in the inner contour form end position.

In the inner contour form end position according to FIG. 10*a*, there is an axial distance $h_r$, which may be referred to as the inner contour residual distance, between the front surface 123 of the inner contour form punch 121 and the front end of the bottom side 107*b* in axial direction A. As indicated in FIG. 10*a*, the residual distance $h_r$ is greater than the preform axial distance $h_S$. Preferably, the inner contour residual distance $h_r$ is at least 1.2 times, at least 1.5 times or at least 2 times as large as the preform axial distance $h_S$. In the case of a narrow stem height $h_S$, the residual inner contour-to-contour distance $h_r$ can be more than 10 times, more than 100 times or even more than 1000 times greater than the preform axial distance $h_S$.

The axial size of the inner contour molding section 122 is, as shown in FIGS. 10*a* and 10*b*, smaller than the axial length of the preform section 112, preferably the axial length of the preform section 112 can be at least 1.2 times, at least 1.5 times, or at least 2 times the axial length of the inner contour molding section 122. The inner contour Holding section 122 is preferably not smaller than 10%, 20%, 30% or 50% of the axial length of the preform section 112 in axial direction A.

In the inner contour forming portion, the result of which is to be seen in the form of the projectile blank (second stage) 1*b* in FIGS. 10*a* and 10*b*, the projectile blank 1*b* is formed so as to form in the axial direction A a sleeve-shaped front portion 3*b* and a rear cylinder portion 5*b*. The frontal cavity 33*b* in the projectile blank 1*b* is formed substantially complementary to the shape of the inner contour forming section 122 of the inner contour forming press 103.

At the bottom 35*b* of the internally shaped cavity 33*b* there is an axial central mouth 37*b*, which merges into shaft 55*b*. In the cylinder section 5*b* of the projectile blank 1*b* (second stage) a deformation sleeve 51*b*, which surrounds the shaft 55*b* radially, is formed. In the case of projectile blank 1*b* according to FIG. 10*b*, the 55*b* shaft extends like a microchannel up to a remaining stem height $h_S$, below the 55*b* channel a fully cylindrical projectile blank stem 7*b* is connected. The projectile blank 1*b* has a calotte recess 73*b* at the foot end 71*b*, which defines the lower end of the projectile blank stem 7*b* and the stem height.

The outer contour 34*b* of the projectile blank 1*b* second stage is essentially fully cylindrical and has both in the cylinder section 5*b* and in the front thin-walled section 3*b* essentially the same outer diameter which preferably corresponds to the projectile (caliber) diameter $D_Z$. The projectile blank of the second stage (1*b*) essentially has the finished shaft (55*b*) shape, which may differ depending on the projectile, as already described in FIGS. 1 to 6. As described in FIG. 9*c* with regard to an alternative projectile blank geometry (1*a*'), a second stage projectile blank (not shown) can, of course, be realized without a stem. The formation of the stem 7*b* of the second stage projectile blank is conditioned by the preforming step in the preforming press 101. If the preforming punch completely penetrates the metal or projectile blank (1*a*') of the first stage, the projectile blank formed from this preformed projectile blank has no stem either.

When the inner contour forming punch 121 is pressed into the preformed projectile blank held in the projectile blank receptacle 105*b* and from the bottom side 107*b* formed by a rear punch, the inner contour 32*a* of the projectile blank is formed in accordance with the inner contour forming section 122. When the inner contour forming punch 121 is pressed into the projectile blank, a front projectile blank section 3*b* is formed thin-walled, preferably with constant wall thickness, in particular at least in sections in the form of a cylindrical sleeve. The metal material of the solid projectile or projectile blank displaced by the inner contour forming punch 121 during this inner contour forming operation is displaced during the inner contour forming step in axial direction A towards the foot or rear (rear) cylinder section 5*b* of the projectile blank (second stage) 1*b*.

The conical shaft 55*a* formed by the preform punch 111 up to the blunt end 113 at the bottom of the inner contour 32*a* is formed by the inner contour punch 121 during the inner contour forming step. The conical channel 55*a* is formed by partial expansion into a wide cylindrical cavity 33*b* near the face 13*b* of the internally contour-formed projectile blank 1*b*. Towards the base 71*b* of the projectile blank 1*b*, the metal material of the projectile blank 1*b* is compressed in axial direction A and in radial direction R during the forming of the cone channel 55*a* by the inner contour forming punch 121, so that in the axial direction A the bottom shoulders 35*b* delimiting the cavity are formed with the central muzzle opening 37*b* and the shaft 55 extending in the axial direction A from the muzzle opening 37*b* into the cylinder section 5*b* of the projectile blank 1*b*.

During manufacture, the deformation sleeve 51*b* surrounding shaft 55*b* provides a manufacturing tolerance, the inner cavities (not shown in FIG. 10*b*) of the deformation cavity initially formed by the conical shaft 55*a* and subsequently being able to accommodate material displaced during the inner contour forming step. In this way, a precisely fitting outer contour 34*b* of the projectile blank 1*b* can be guaranteed without reworking, for example by calibration or milling.

FIG. 11 shows the ogival form press 200. As a main component, the ogival form press 200 comprises a rear punch 207 and a projectile receptacle 205 with a projectile tip forming punch 213 for inserting the preformed and/or inner contour formed projectile blank. This is held or at least centered by the rear punch 207 and inserted into a stationary part of the ogival form press 200 consisting essentially of the projectile receiving 205 and the projectile tip punch 213. The projectile tip punch 213 together with the projectile receptacle 205 defines the curved outer contour 203 for the ogive. The ogive matrix or projectile receptacle 205 is hollow cylindrical with an ogive-shaped inner contour. In axial direction A, the ogival inner contour 203 of the projectile receptacle 205 preferably continuously merges into the ogival surface of the bottom side 213 of the point punch or face punch, in particular free of cracks and/or edges.

When the projectile blank with the projectile rear punch 207 is inserted into the projectile blank receptacle 205 relative to the bottom side 213 defined by the point punch, the metal material of the front case section 23 is deformed like an ogival so that projectile 2 is formed from the projectile blank. In the ogival-shaped final position, depicted in FIG. 11, the ogival-shaped projectile 2 is made in sections from the projectile blank. The projectile 2 can then be reworked, for example, by levelling. The cylinder section 25 of projectile 2 is preferably not deformed during the ogival progress, so that it preferably retains its outer diameter completely, in particular according to the (caliber) projectile diameter $D_Z$.

The pressing tools or presses (100, 101, 103, 200) can be equipped with mechanical limit switches and/or force-dependent limit switches and/or travel-dependent limit switches to define the relative position of the bottom side to the respective ram in the respective end position. Tool receptacles and dimensions can vary depending on the caliber, plant and/or embodiment of the tool.

The features revealed in the above description, in the figures and in the claims may be relevant, either individually or in any combination, to the realization of the invention in its various configurations.

DE 10 2016 009 571.7

REFERENCE LIST

1, 1.1, 1.2, 1.3, 1.4 Solid projectile
1.5, 1.6, 2 Solid projectile
1*a*, 1*b* Projectile blank
1*x* Metallic blank

3, 23 Ogival portion
5, 25 Cylinder portion
3*a*, 5*b* Sleeve portion
7 Stem portion
11 Opening
13 Tip
31, 31*a*, 31*b* Ogival wall
32, 32*a*, 32*b* Inner contour
33, 33*b* Ogival cavity
34, 34*a*, 34*b* Outer contour
35, 35*a*, 35*b* Bottom
51 Deformation cylinder
53 Deformation cavity
55,55*a*,55*b* Shaft
57 Microchannel
71, 71*a*, 71*b* Rear
73, 71*a*, 71*b* Calotte
75, 75*a*, 75*b* Truncated cone section
100 Setting press
101 Preform press
103 Inner contour forming press
105*a* Metallic blank receptacle
105*b*, 105*x* Projectile blank receptacle
107*a*, 107*b*, 107*x* Bottom side
111 Preform punch
112 Preform portion
113, 123 Front surface
115, 125 Guide section
121 Inner contour forming punch
122 inner contour forming portion
133 Sleeve forming section
200 Ogival forming press
203 Ogival portion
205 Projectile receptacle
207 Projectile rear punch
213 Bottom side
A Rotational axis/Axial direction
R Radial direction
$d_O$ Opening diameter
$D_Z$ Cylinder diameter
$h_S$ Stem height
$h_{Ra}$ Height (Preform cavity)
$h_{Rb}$ Height (Inner contour forming cavity)
$l_G$ Projectile length
$l_H$ Shaft height
$l_O$ Ogival portion height
$l_S$ Stem height
$l_Z$ Cylinder section height

The invention claimed is:

1. A tool arrangement for producing metallic solid projectiles for practice cartridges, comprising a preform press having a hollow cylindrical projectile blank receptacle which is bounded in the axial direction by a bottom side, a preform punch, having a preform portion which tapers in the axial direction relative to a front surface in the form of a truncated cone, the preform portion being movable relative to the bottom side for forming a projectile blank to a preform end position in which the preform punch, the bottom side and the projectile blank receptacle define a preform cavity for the projectile blank, wherein in the preform end position, an axial distance between the bottom side and the front surface is less than 45% of a maximum height of the cavity in the axial direction.

2. The tool arrangement according to claim 1 further comprising an inner contour forming press having a hollow cylindrical projectile blank receptacle which is bounded in the axial direction by a bottom side, and an inner contour forming punch comprising an inner contour forming portion extending axially to a front surface, the inner contour forming portion being movable relative to the bottom side for forming the projectile blank to an inner contour forming end position, wherein the inner contour forming punch, the bottom side and the projectile blank receptacle define an inner contour forming cavity for the projectile blank, wherein an axial distance between the bottom side and the front surface is greater than the axial distance between the bottom side of the preform press and the front surface of the preform punch in the preform end position.

3. The tool arrangement according to claim 2, wherein the front surface of the inner contour forming punch is formed as a blunt cone tip and/or the inner contour forming portion is formed in sections in the axial direction as a sleeve forming section with an essentially cylindrical outer contour.

4. The tool arrangement according to claim 2, wherein the taper of the preform portion of the preform punch is sharper than the tapered outer contour of the inner contour portion of the inner contour punch.

5. The tool arrangement according to claim 1, wherein the tool arrangement further comprises a setting press having a hollow cylindrical metal blank receptacle bounded in axial direction by a bottom side and having a setting punch, which is movable relative to the bottom side for forming the metal blank up to a setting end position, in which the setting punch and the projectile blank receptacle form a setting cavity with a predetermined clear width for defining a constant outer diameter of the metal blank.

6. The tool arrangement according to claim 1, wherein the tool arrangement further comprises an ogival forming press which has a hollow cylindrical projectile receptacle which is bounded in the axial direction by a concave, ogival-shaped bottom side and which has a projectile rear punch for holding and/or centering the rear end of the internally contour-shaped projectile blank, which is movable relative to the bottom side for forming the solid projectile to an ogival shape end position, in which the projectile rear punch, the projectile receptacle and the bottom side define a cavity defining a projectile negative with an ogival portion and a cylinder portion adjacent thereto.

7. A method for producing metallic solid projectiles for practice cartridges, in which a metal blank is provided, with a cylindrical outer surface, wherein, in a preforming step, the metal blank is formed into a projectile blank with a sleeve-shaped portion which, at the end of the preforming step, extends over more than half of the greatest axial blank height, and wherein the projectile blank is deformed after the preforming step in an inner contour forming step in such a manner, that a front-side sleeve portion of the projectile blank is formed with a radially outer sleeve wall of substantially constant wall thickness and/or cylindrical inner contour, that a rear-side sleeve portion of the projectile blank is formed with a shoulder projecting radially inwards from the sleeve wall, and that a shaft starting from the shoulder is formed which extends into the rear-side sleeve portion of the projectile blank, which shaft forms a microchannel and/or a deformation cavity, wherein the deformation cavity is formed at least sectionally cylindrically and/or at least sectionally conically with taper at the end.

8. The method according to claim 7, wherein the metal blank is formed in the preforming step while maintaining a remaining fully-cylindrical stem portion of a projectile blank extending in the axial direction over less than 45% of the greatest axial blank height, or in that the metal blank is completely penetrated in the axial direction in the preforming step for forming the projectile blank.

9. The method according to claim 7, wherein in the inner contour forming step the projectile blank is being formed in such a way, that the deformation cavity forms a waist-shaped constriction at the front side, wherein a microchannel is formed between the deformation cavity and the shoulder, in which microchannel the inner wall surface of the sleeve section is brought together flat in contact, and/or that a distance in the axial direction between the shoulder and a rear becomes greater than the axial height of the fully cylindrical stem portion of the projectile blank which may be present at the end of the preforming step.

10. The method according to claim 7, wherein the projectile blank, is formed in an ogival forming step in such a way that the front side sleeve wall forms an ogival outer surface in sections.

11. The method according to claim 7, wherein the preforming step, the inner contour forming step and/or the ogival forming step are carried out without cutting.

* * * * *